US006968141B2

(12) United States Patent
Fujita et al.

(10) Patent No.: US 6,968,141 B2
(45) Date of Patent: Nov. 22, 2005

(54) REMANUFACTURING METHOD FOR TONER SUPPLY CONTAINER

(75) Inventors: Akiyoshi Fujita, Numazu (JP); Atsushi Numagami, Hadano (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/694,864

(22) Filed: Oct. 29, 2003

(65) Prior Publication Data

US 2004/0131383 A1 Jul. 8, 2004

(30) Foreign Application Priority Data

Oct. 31, 2002 (JP) ..... 2002-318296

(51) Int. Cl.[7] ..... G03G 15/00
(52) U.S. Cl. ..... 399/109
(58) Field of Search ..... 399/27, 103, 106, 399/109, 119, 120, 258, 262, 263

(56) References Cited

U.S. PATENT DOCUMENTS

| | | | | |
|---|---|---|---|---|
| 5,729,795 | A * | 3/1998 | Kavolius et al. | 399/109 |
| 5,870,652 | A | 2/1999 | Kanamori et al. | 399/106 |
| 6,021,291 | A | 2/2000 | Karakama et al. | 399/104 |
| 6,038,414 | A | 3/2000 | Inami et al. | 399/104 |
| 6,044,237 | A | 3/2000 | Numagami et al. | 399/104 |
| 6,128,453 | A | 10/2000 | Ban et al. | 399/106 |
| 6,144,820 | A | 11/2000 | Ishii et al. | 399/90 |
| 6,173,128 | B1 * | 1/2001 | Saber et al. | 399/109 X |
| 6,185,393 | B1 | 2/2001 | Karakama et al. | 399/103 |
| 6,195,515 | B1 | 2/2001 | Fujita et al. | 399/103 |
| 6,219,506 | B1 * | 4/2001 | Morinaga et al. | 399/109 |
| 6,278,853 | B1 * | 8/2001 | Ban et al. | 399/109 |
| 6,336,015 | B1 | 1/2002 | Numagami | 399/104 |
| 6,549,735 | B2 | 4/2003 | Fujita et al. | 399/103 |
| 6,587,660 | B2 | 7/2003 | Ueno et al. | 399/252 |
| 2002/0150410 | A1 | 10/2002 | Matsuda et al. | 399/263 |

FOREIGN PATENT DOCUMENTS

| | | |
|---|---|---|
| EP | 0 661 609 A2 | 7/1995 |
| EP | 0 740 227 A1 | 10/1996 |
| EP | 1 184 742 A2 | 3/2002 |
| JP | 7-261524 | 10/1995 |
| JP | 11-73000 | 3/1999 |

* cited by examiner

*Primary Examiner*—Sandra L. Brase
(74) *Attorney, Agent, or Firm*—Fitzpatrick, Cella, Harper & Scinto

(57) ABSTRACT

A remanufacturing method for a developer supply container detachably mountable to a main assembly of an image forming apparatus, the developer supply container including a frame, a developer accommodating portion for accommodating a developer to be used by a developing device of the image forming apparatus, a developer filling opening for filling the developer into the developer accommodating portion, a capping member for closing the developer filling opening, and a cap covering member covering the capping member, the cap covering member being fixed by welding to the frame, the remanufacturing method including a cap covering member dismounting step of dismounting the cap covering member from the frame by separating cap covering member from the frame at a welded portion; a capping member dismounting step of dismounting the capping member to open the developer filling opening; a developer filling step of filling the developer with the developer filling opening; a capping member mounting step of closing the developer filling opening by a capping member; a cap covering member mounting step of mounting the cap covering member to the frame.

12 Claims, 14 Drawing Sheets

REMANUFACTURING METHOD FOR TONER SUPPLY CONTAINER

FIELD OF THE INVENTION AND RELATED ART

The present invention relates to a method for remanufacturing a developer supply container removably mountable in the main assembly of an image forming apparatus.

Toner in the form of a micro-particle has long been used as the developer for an electrophotographic image forming apparatus. Here, an electrophotographic image forming apparatus means an apparatus which forms an image on recording medium with the use of one of the electrophotographic image forming methods. As for examples of an electrophotographic image forming apparatus, there are an electrophotographic copying machine, an electrophotographic printer (laser beam printer, LED printer, etc.), a facsimileing machine, a word processor, etc.

When the amount of the toner in the main assembly of an image forming apparatus has reduced to a critical level due to consumption, the main assembly is provided with toner with the use of a toner supply container.

Toner is in the form of an extremely small particle, being therefore prone to scatter. Therefore, the following method has been known as one of the methods for supplying an image forming apparatus with toner while preventing toner from scattering. That is, a toner supply container is placed within the main assembly of an image forming apparatus, and toner is discharged little by little from the toner outlet, that is, a small hole with which the toner supply container is provided, to be delivered to the toner inlet of the toner destination.

In the case of the above described type of toner supplying method, it is difficult for toner be automatically discharged by gravity alone. Therefore, some kind of a toner conveying means is necessary.

In order to efficiently convey the toner in a toner supply container, it is desired that the toner supply container is provided with a toner stirring means in addition to a toner conveying means. As a toner supply container such as the one described above, there is the toner supply container disclosed in Japanese Laid-open Patent Application 11-073000, for example.

Not only is this type of toner supplying method effective to supply toner by neither too much nor too little, but also to keep constant the amount of the toner in a developing apparatus. It is also effective to maintain the ratio between the toner and carrier at a predetermined level, when two-component developer is employed.

Japanese Laid-open Patent Application 7-261524 discloses another structural arrangement for a toner supply container. According to this arrangement, a toner supply container is provided with a handle, which is used when mounting the container into the main assembly of a developing apparatus, or dismounting it therefrom. The handle is disposed in a manner to cover a capping member for keeping sealed the toner inlet of the container. It is provided with a claw or the like, which engages with the catch portion of the toner supply container. According to one of the methods for remanufacturing such a toner supply container as the one described above, the handle which is covering the capping member is removed to access the capping member.

In the case of the above described toner supply container, the toner therein is continuously consumed during an image forming operation, and as the amount of the toner in the toner supply container is reduced by consumption to a critical level, that is, the level below which it is impossible to form an image satisfactory in quality to a user who purchased the toner supply container, the toner supply container loses its commercial value.

It has been desired to make commercially viable, a toner supply container exhausted of the toner therein, that is, a toner supply container having lost its commercial value, by remanufacturing it, in order to make better use of the frame, and various internal components, such as stirring member, etc., of the toner supply container.

Here, developer means toner as well as a mixture of toner and carrier.

According to one of the typical developer supply container remanufacturing methods, a developer supply container having an expired service life is recovered, is refilled with a fresh supply of developer, and is resealed with the combination of a capping member and a capping member cover to prevent developer leak. With this method, even if a developer supply container loses its commercial value due to usage, it can be reused; it can be remanufactured as a commercially viable toner supply container. In other words, the structural components of a used toner supply container, more specifically, the frame, internal stirring members, developer conveying means, memory elements having a communicating means capable of communicating with the counterpart of the main assembly of an image forming apparatus, coupling members for transmitting driving force, etc., of a developer supply container can be more efficiently reused.

It should noted here that the present invention includes all of the following methods for remanufacturing a developer container:

(1) a developer container remanufacturing method which remanufactures a used developer supply container, using only the components from the very developer supply container to be remanufactured.

(2) a developer container remanufacturing method which remanufactures a used developer supply container, using only the components from the very developer supply container to be remanufactured, except for the components which cannot be reused, for example, the components having expired in service life, damaged components, etc., and which therefore will be replaced with brand new ones, or those from other used developer containers.

(3) a developer container remanufacturing method in which various components removed from multiple used developer supply containers are sorted, and multiple commercially viable developer supply containers are made using the mixture of reusable components selected from among the sorted components.

(4) a developer container remanufacturing method in which various components removed from multiple used developer supply containers are sorted, and multiple commercially viable developer supply containers are made using the mixture of reusable components selected from among the sorted components, except for the components which are not reusable, for example, the components having expired in service life, damaged components, etc., and which therefore will be replaced with brand new ones, or those from other groups of used developer containers.

Incidentally, the above described component means each of the structural components of a developer supply container, that is, a part of a developer supply container, disclosed in the Claims. It also means the smallest sections, or the smallest operational units, into which a developer supply container can be disassembled.

SUMMARY OF THE INVENTION

The primary object of the present invention is to provide a simple method for remanufacturing a toner supply container.

Another object of the present invention is to provide a toner supply container remanufacturing method capable of preventing toner from leaking from a remanufactured toner supply container while the remanufactured toner supply container is transported, or in the like situations.

Another object of the present invention is to provide a toner supply container remanufacturing method capable of making commercially viable, a used toner supply container after the amount of the toner therein reduces to a critical level, that is, the level below which an image satisfactory in quality to a user cannot be formed, in other words, after it loses its commercial value.

Another object of the present invention is to provide a toner supply container remanufacturing method which makes it easy to remove the thermally crimped portion of a used toner supply container.

Another object of the present invention is to provide a method for remanufacturing a toner supply container which comprises: a frame; a developer storage portion for storing the developer used by a developing apparatus; a developer inlet through which developer is filled into said developer storage portion; a capping member for sealing said developer inlet; and a capping member covering member for covering said capping member, and which is removably mountable in the main assembly of an image forming apparatus, characterized in that it comprises: a capping member covering member removing step in which the welding of the capping member covering member to the frame is undone, and the capping member covering member is removed from the frame; a capping member removing step in which the capping member is removed to open the developer inlet; a developer filling step in which developer is filled into the developer supply container through the developer inlet; a cap attaching step in which the developer inlet of the developer supply container is sealed with the capping member; and a capping member covering member attaching step in which the capping member covering member is attached to the frame.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described in detail with reference to the appended drawings. In the following descriptions, the measurements, materials, and shapes of the structural components, in the embodiments, and their positional relationships, etc., are not intended to limit the scope of the present invention, unless specifically noted.

In the following descriptions of the embodiments, the lengthwise direction means the direction parallel to the direction in which a process cartridge is mounted into an image forming apparatus. It is intersectional (roughly perpendicular) to the direction in which a recording medium 2 is conveyed, and is parallel to the axial line of an electrophotographic photoconductive drum (which hereinafter will be referred to as photoconductive drum 7). The left and right sides of a process cartridge means the left and right sides as seen from the upstream side in terms of the direction in which the recording medium 2 is conveyed. Further, the top and bottom sides of a cartridge mean the top and bottom sides of the cartridge properly situated in the main assembly of an electrophotographic image forming apparatus.

[Description of General Structure of Image Forming Apparatus]

Figure 1:
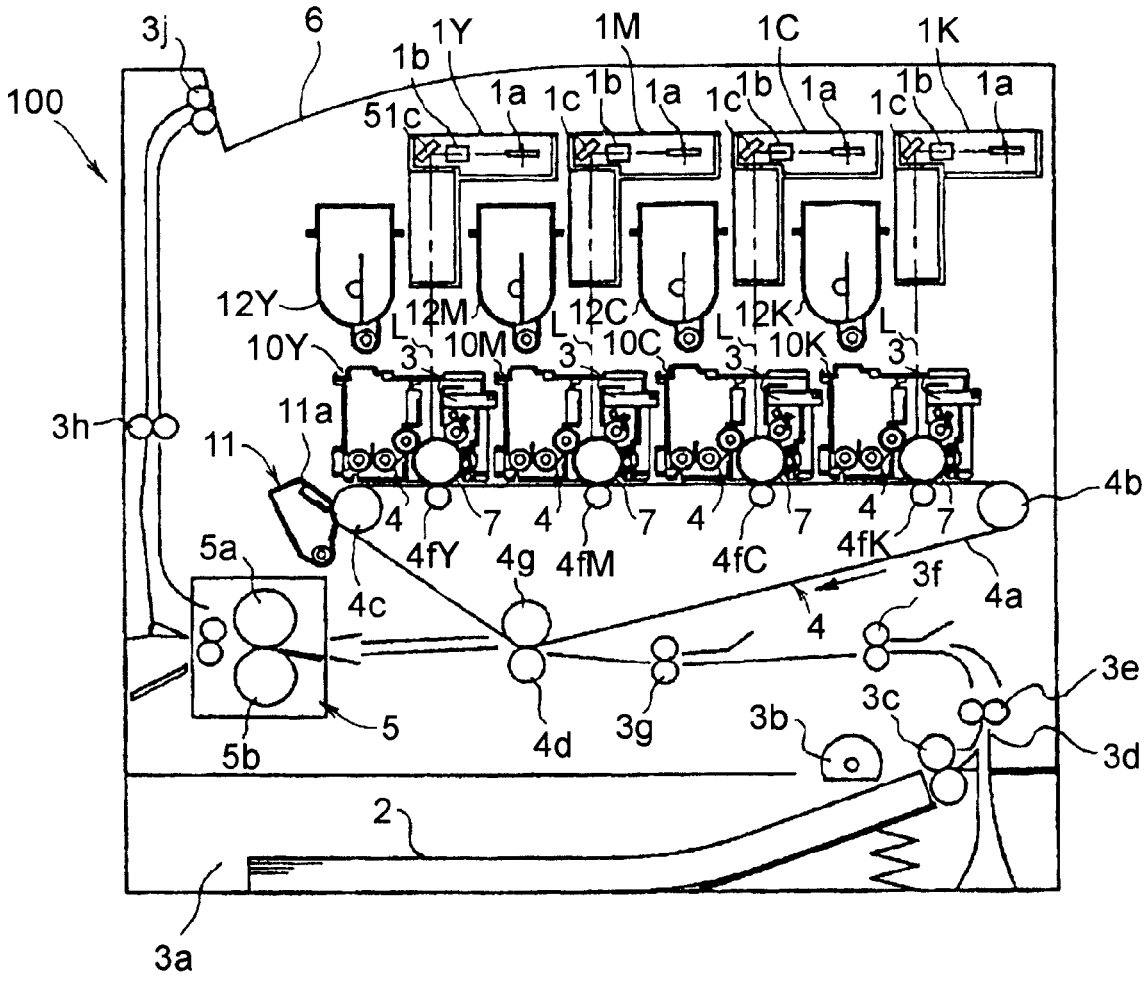
FIG. 1 is a schematic sectional view of a typical image forming apparatus in a preferred embodiment of the present invention.

First, referring to FIG. 1, the general structure of a typical electrophotographic color image forming apparatus will be described. FIG. 1 is a schematic sectional view of an image forming apparatus in the preferred embodiment of the present invention. More specifically, it is a drawing for describing the general structure of a color laser beam printer, that is, one form of an electrophotographic color image forming apparatus.

The image forming portion of this electrophotographic image forming apparatus (color laser beam printer) in this embodiment employs four process cartridges 10Y, 10M, 10C, and 1OK (corresponding to yellow, magenta, cyan, and black color components, respectively), each of which has an electrophotographic photoconductive member in the form of a drum (which hereinafter will be referred to as photoconductive drum). The image forming portion has four exposing means (laser beam optical scanning system) 1Y, 1M, 1C, and 1K, which are disposed in parallel and are aligned in the horizontal direction. The four exposing means 1Y, 1M, 1C, and 1K are located above the process cartridges 10Y, 10M, 10C, and 10K, being roughly vertically aligned one for one with the four process cartridges 10Y, 10M, 10C, and 10K.

Disposed below the above described image forming portion is a feeding means for feeding a recording medium 2 into the main assembly, and an intermediary transfer belt 4*a* onto which a toner image formed on the photoconductive drum 7 is transferred, and a secondary transfer roller 4*d* for transferring the toner images on the transfer belt 4*a*, onto the recording medium 2 on the intermediary transfer belt 4*a*.

The image forming apparatus is also provided with a fixing device 5 as a fixing means for fixing the toner images which have been transferred onto the recording medium 2, and discharge rollers 3*h* and 3*j* for discharging the recording medium 2 out of the image forming apparatus main assembly and accumulating it.

The recording medium 2 is, for example, a piece of recording paper, OHP sheet, fabric, or the like.

The image forming apparatus in this embodiment is a cleaner-less apparatus. Thus, the transfer residual toner, that is, the toner remaining on the photoconductive drum 7 after transfer is taken in by the developing means. Therefore, the process cartridges 10Y, 10M, 10C, and 10K are not provided with a cleaner dedicated to the recovery and storage of the transfer residual toner.

Next, the structures of the various portions of the image forming apparatus will be described in detail in the logical order.

[Feeding Portion]

The feeding portion (sheet feeding means) is a portion for conveying the recording medium 2 to the image forming portion. It essentially comprises: a feeding cassette 3*a* which holds a plurality of recording mediums 2; a feed roller 3*b*; a pair of retard rollers 3*c* for preventing two or more recording mediums 2 from being fed at the same time; a guide 3*d*; and a pair of registration rollers 3*g*.

The feeding roller 3*b* is rotationally driven in synchronism with an image forming operation, taking the recording mediums 2, virtually one by one, out of the feeding cassette 3*a* and feeding them into the apparatus main assembly. The recording medium 2 is conveyed to the registration rollers 3*g* by the conveying rollers 3*e* and 3*f* while being guided by the guide 3*d*.

Immediately after the release of the recording medium 2, the rotation of the registration rollers 3*g* is stopped, and the registration rollers 3*g* are again kept stationary. Thus, as the recording medium 2 collides with the nip between the pair of registration rollers 3*g*, if it is slanted at this point, it is unslanted.

During an image forming operation, the registration rollers 3*g* repeat the sequence of being kept stationary for keeping a recording medium 2 on standby, and being rotated for conveying the recording medium 2 toward the intermediary transfer belt 4*a*, in order to align a toner image with the recording medium 2, for the subsequent transfer process.

[Process Cartridge]

Figure 2:
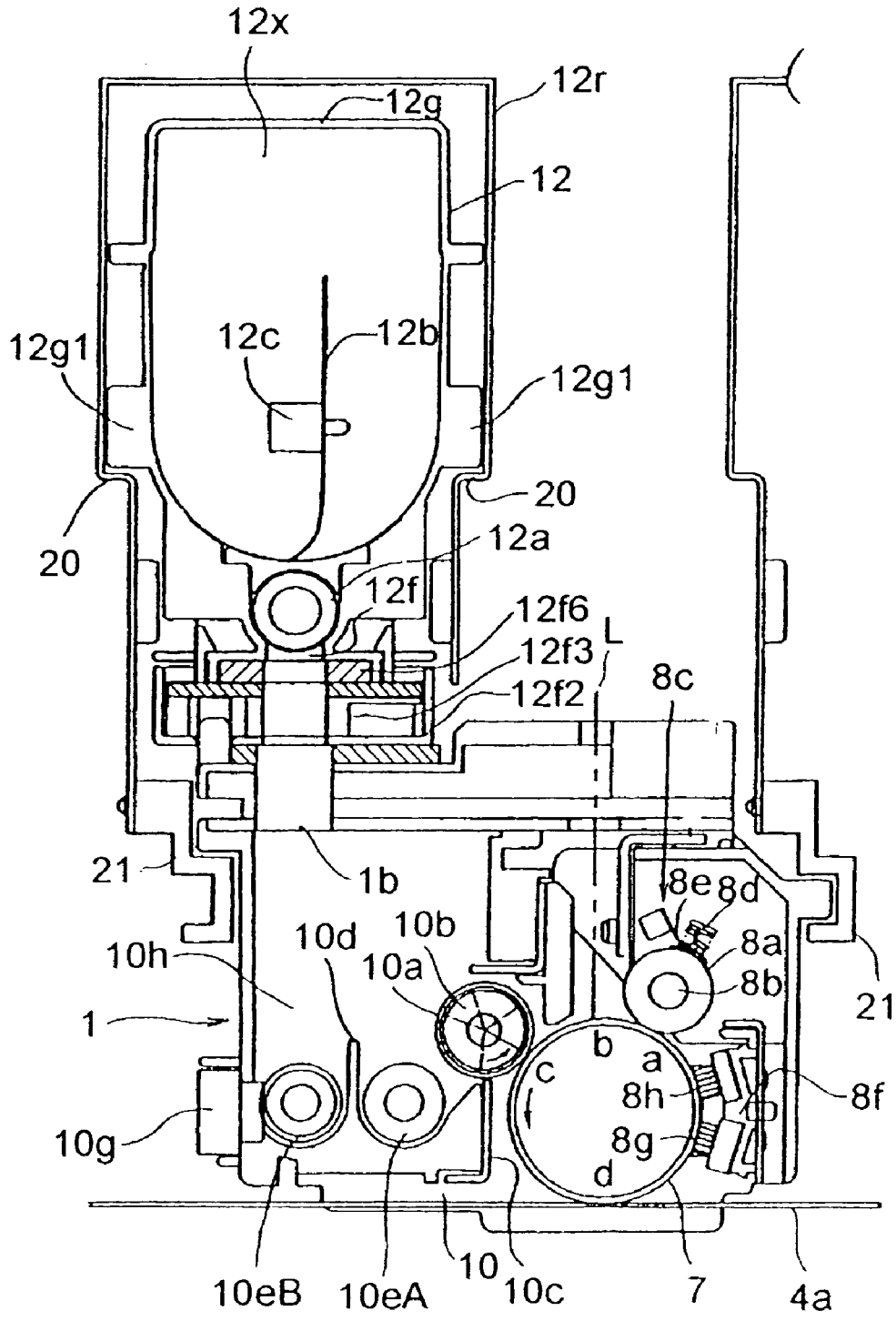
FIG. 2 is a schematic sectional view of the properly connected combination of a toner supply container and a process cartridge, in the preferred embodiment of the present invention.

FIG. 2 is a schematic sectional view of the properly connected combination of the toner supply container and process cartridge in the preferred embodiment of the present invention.

Referring to FIG. 2, in each of the process cartridges 10Y, 10M, 10C, and 10K, a charging means 8 and a developing means are integrally disposed around the peripheral surface of the photoconductive drum 7. These process cartridges 10Y, 10M, 10C, and 10K can be easily removed from the main assembly 100 of an electrophotographic image forming apparatus (which hereinafter will be referred to as apparatus main assembly) by a user, and are to be replaced at the end of the service life of the photoconductive drum 7.

As for the method for determining whether or not the service life of the process cartridge 10 has reached its end, the rotations of the photoconductive drum 7 are counted, and as the cumulative number of the rotations exceeds a predetermined value, a user is warned that the service life of the process cartridge 10 has reached its end.

The photoconductive drum 7 in this embodiment is an organic photoconductive member, the inherent polarity of which is negative. It comprises a hollow aluminum drum, as a base member, with a diameter of approximately 30 mm, a layer of an ordinary photoconductive substance coated on the peripheral surface of the base member, and a charge injection layer as an outermost layer coated on the photoconductive layer. It is rotationally driven at a predetermined process speed, which in this embodiment is approximately 117 mm/sec.

The charge injection layer is a coated layer of a mixture of insulating resin as binder, and micro-particles of electrically conductive substance, for example, $SnO_2$, dispersed in the binder.

The photoconductive drum 7 is provided with a drum flange 7*b*, which is solidly attached to the back end (FIG. 4) of the photoconductive drum 7, that is, the leading end of the photoconductive drum 7 in terms of the direction in which the process cartridge 10 is inserted into the main assembly 100, and a drum flange 7*d*, which is solidly attached to the front end, from which the photoconductive drum 7 is not driven. The photoconductive drum 7 is also provided with a drum shaft 7*a*, which penetrates the centers of the drum flanges 7*b* and 7*d*. The drum shaft 7*a* is connected to the flange 7*d* so that it rotates with the flange 7*d*. In other words, the photoconductive drum 7 is rotated about the axis of the drum shaft 7*a*.

The front end portion of the drum shaft 7*a* is rotationally supported by a bearing 7*e*, which is solidly fixed to a bearing case 7*c*, which is solidly fixed to the frame of the process cartridge 10.

[Charging Means]

The charging means in this embodiment employs one of the contact type charging methods. It employs a charge roller 8*a* as a charging member.

Referring to FIG. 2, the charge roller 8*a* is rotatably supported by a pair of unshown bearings, at the lengthwise end portions of its metallic core 8*b*. It is kept pressured toward the photoconductive drum 7 by a pair of compression springs 8*d*; it is kept in contact with the peripheral surface of the photoconductive drum 7, so that a predetermined amount of contact pressure is maintained between the photoconductive drum 7 and the charge roller 8*a*. It is rotated by the rotation of the photoconductive drum 7.

Designated by a referential number 8*c* is a cleaning unit for cleaning the charge roller 8*a*. The charge roller cleaning unit 8*c* in this embodiment has a flexible cleaning film 8*e*, which extends in the lengthwise direction of the charge roller 8*a*, in parallel to the charge roller 8*a*. The cleaning film 8*e* is solidly fixed, by one of the long edges thereof, to a supporting member 8*f* which is reciprocally movable a predetermined distance in the lengthwise direction of the charge roller 8*a*. The cleaning film 8*e* is disposed so that the free lengthwise edge portion of the cleaning film 8*e* forms a contact nip against the peripheral surface of the charge roller 8*a*. Thus, as the supporting member 8*f* is reciprocally moved 5 mm in the lengthwise direction of the cleaning film 8*e*, by an external driving means, the peripheral surface of the charge roller 8*a* is rubbed by the film 8*e*. As a result, the contaminants (minute particles of toner, external additive, etc.) adhering to the peripheral surface of the charge roller 8*a* are removed.

Incidentally, the image forming apparatus in this embodiment is of a cleaner-less type. Next, the cleaner-less system will be described.

[Cleaner-less System]

Referring to FIG. 2, the outline of the cleaner-less system of the image forming apparatus in this embodiment will be described. In the case of the cleaner-less system in this embodiment, the transfer residual toner, that is, the toner remaining on the photoconductive drum 7 after the aforementioned toner image transfer is conveyed further by the subsequent rotation of the photoconductive drum 7 through the charging portion a and exposing portion b, and into the development portion c, in which the transfer residual toner is recovered (photoconductive drum is cleaned) by the developing means at the same time as a latent image on the photoconductive drum 7 is developed by the developing means.

Since the transfer residual toner on the peripheral surface of the photoconductive drum 7 is moved past the exposing portion b, the peripheral surface of the photoconductive drum 7 is exposed with the presence of the transfer residual toner thereon. However, the transfer residual toner is very small in quantity, not significantly affecting the exposing process.

Incidentally, in terms of polarity, the transfer residual toner is a mixture of normally charged toner particles and reversely charged toner particles (reversal toner particles), and, in terms of the amount of charge, it is a mixture of fully charged toner particles and insufficiently charged toner particles. These reversely charged toner particles and insufficiently charged toner particles sometimes adhere to the charge roller 8*a*, contaminating thereby the charge roller 8*a*. If the contamination exceeds the permissible level, it is possible for the photoconductive drum 7 to be improperly charged.

In order to assure that the transfer residual toner on the peripheral surface of the photoconductive drum 7 is satisfactorily removed by the developing apparatus at the same time as a latent image on the peripheral surface of the photoconductive drum 7 is developed by the developing apparatus, it is necessary that the transfer residual toner, on the peripheral surface of the photoconductive drum 7, which is to be conveyed to the developing portion c, is positive in polarity, and also that the amount of electrical charge of the transfer residual toner is equal to the value which makes it possible to develop the electrostatic latent image on the photoconductive drum 7 by the developing apparatus. The reversely charged toner particles, and the insufficiently charged toner particles, cannot be removed from the peripheral surface of the photoconductive drum 7 by the developing means, and therefore, cannot be recovered, causing therefore the formation of a defective image.

In recent years, user needs have diversified. One of the diversified user needs is to print an image with a higher printing ratio, for example, a photographic image, which requires a continuous long printing operation, generating all at once a substantial amount of transfer residual toner, exacerbating thereby the above described problem.

In this embodiment, therefore, a transfer residual toner (residual toner image) redistributing means 8*g* for redistributing the transfer residual toner particles on the photoconductive drum 7 evenly in terms of the lengthwise direction of the photoconductive drum 7, is disposed on the downstream side of the transfer portion d, in terms of the rotational direction of the photoconductive drum 7. Further, in order to make all the transfer residual toner particles normally charged, that is, negatively charged, a toner charge controlling means 8*h* for charging the reversely charged toner particles to negative polarity, is disposed between the downstream side of the toner redistributing means 8*g*, and the upstream side of the charging portion a, in terms of the rotational direction of the photoconductive drum 7.

With the provision of the toner redistributing means 8*g*, the transfer residual toner particles, which are remaining, in a certain pattern, on the photoconductive drum 7 and are conveyed from the transfer portion d to the toner charge controlling means 8*h*, are evenly redistributed across the peripheral surface of the photoconductive drum 7, losing therefore the pattern in which they have been adhering to the peripheral surface of the photoconductive drum 7, even if their amount is substantial. Therefore, the problem that the toner particles concentrate on certain portions of the toner charge controlling means 8*h* is eliminated, assuring thereby that the reversely charged residual toner particles are normally charged by the toner charge controlling means 8*h* so that all of the transfer residual toner particles become normal in polarity. Therefore, the adhesion of the transfer residual toner to the charge roller 8*a* is effectively prevented, and also the creation of a ghost image reflecting the pattern in which the transfer residual toner particles remain on the photoconductive drum 7 is prevented.

The toner redistributing means 8*g* and toner charge controlling means 8*h*, in this embodiment, are in the form of a brush with a proper degree of electrical conductivity, and are placed in contact with the photoconductive drum 7, with their brush portions in contact with the peripheral surface of the photoconductive drum 7.

These means 8*g* and 8*h* are structured so that they are moved (reciprocally) in the lengthwise direction of the photoconductive drum 7, by an unshown driving force source. With the provision of this structural arrangement, the toner redistributing means 8*g* and toner charge controlling means 8*h* do not remain in contact with the same ranges of the peripheral surface of the photoconductive drum 7 in terms of the axial direction of the photoconductive drum 7. Therefore., it does not occur that a given portion of the peripheral surface of the photoconductive drum 7 is always contacted by the same portion of the toner charge controlling means 8*h*. Thus, even if the irregularity in electrical resistance across the toner charge controlling means 8*h* makes some portions of the toner charge controlling means 8*h* excessive in charging performance, and the other portions insufficient in charging performance, the problem that the transfer residual toner particles on certain areas of the peripheral surface of the photoconductive drum 7 are excessively charged, being thereby welded to the areas, and/or the problem that the insufficiently charged transfer residual toner particles adhere to certain areas of the peripheral surface of the charge roller 8*a*, are prevented or mitigated.

[Exposing Means]

In this embodiment, the aforementioned photoconductive drum 7 is exposed by a laser exposing means 1Y, 1M, 1C, and 1K. More specifically, as image formation signals are sent to the exposing means from the image forming apparatus 100, a beam of laser light L is projected from the exposing means, while being modulated with the image formation signals, onto the photoconductive drum 7, in a manner to scan the uniformly charged portion of the peripheral surface of the photoconductive drum 7, selectively exposing numerous points on the uniformly charged portion of the peripheral surface of the photoconductive drum 7 (FIG. 2). As a result, an electrostatic latent image in accordance with the image formation information is formed on the peripheral surface of the photoconductive drum 7.

The laser exposing means 1Y, 1M, 1C, and 1K each comprise: a solid laser element (unshown), a polygon mirror 1*a*, a focusing lens 1*b*, a reflection mirror 1*c*, etc. In operation, the solid laser element is turned on and off by an optical signal generating device (unshown), in response to the inputted image formation signals. The beam of laser light L irradiated from the solid laser element is converted by a collimator lens system (unshown) into virtually parallel rays of light, and is projected onto the polygon mirror 1*a*, which is being rotated at a high peripheral velocity. As a result, the parallel rays of light are oscillated in a scanning manner. Then, it is further projected by way of the focusing lens 1*b* and reflection mirror 1*c*, forming an oscillating spot of light on the peripheral surface of the photoconductive drum 7.

Thus, as the spot of light oscillates, the peripheral surface of the photoconductive drum 7 is exposed in terms of the primary scanning direction, and as the photoconductive drum 7 is rotated, it is exposed in terms of the secondary scanning direction. As a result, numerous points on the peripheral surface of the photoconductive drum 7 are exposed or remain unexposed in such a manner that the distribution of the exposed and unexposed points reflects the image formation signal sequence.

In other words, the points (exposed points) with the reduced potential level, and the points (unexposed points) with the normal potential level, are created, the contrast among which effects an electrostatic latent image in accordance with the image formation information.

[Developing Apparatus]

The process cartridge 10, which comprises a developing apparatus as a developing means, is of a contact type developing apparatus which uses two-component developer (two-component magnetic brush type developing apparatus). Referring to FIG. 2, the cartridge 10 comprises a development sleeve 10*a* as a developer bearing member, and a magnetic roller 10*b* disposed within the hollow of the development sleeve 10*a*. The sleeve 10*a* holds a layer of developer, which is a mixture of carrier and toner, on its peripheral surface. The cartridge 10 also comprises a regulating blade 10*c*, which is disposed in the adjacencies of the peripheral surface of the sleeve 10*a*, with the presence of a predetermined distance from the sleeve 10*a*. As the sleeve 10*a* is rotated in the direction indicated by an arrow mark, a thin layer of developer is formed on the peripheral surface of the sleeve 10*a*.

Figure 4:
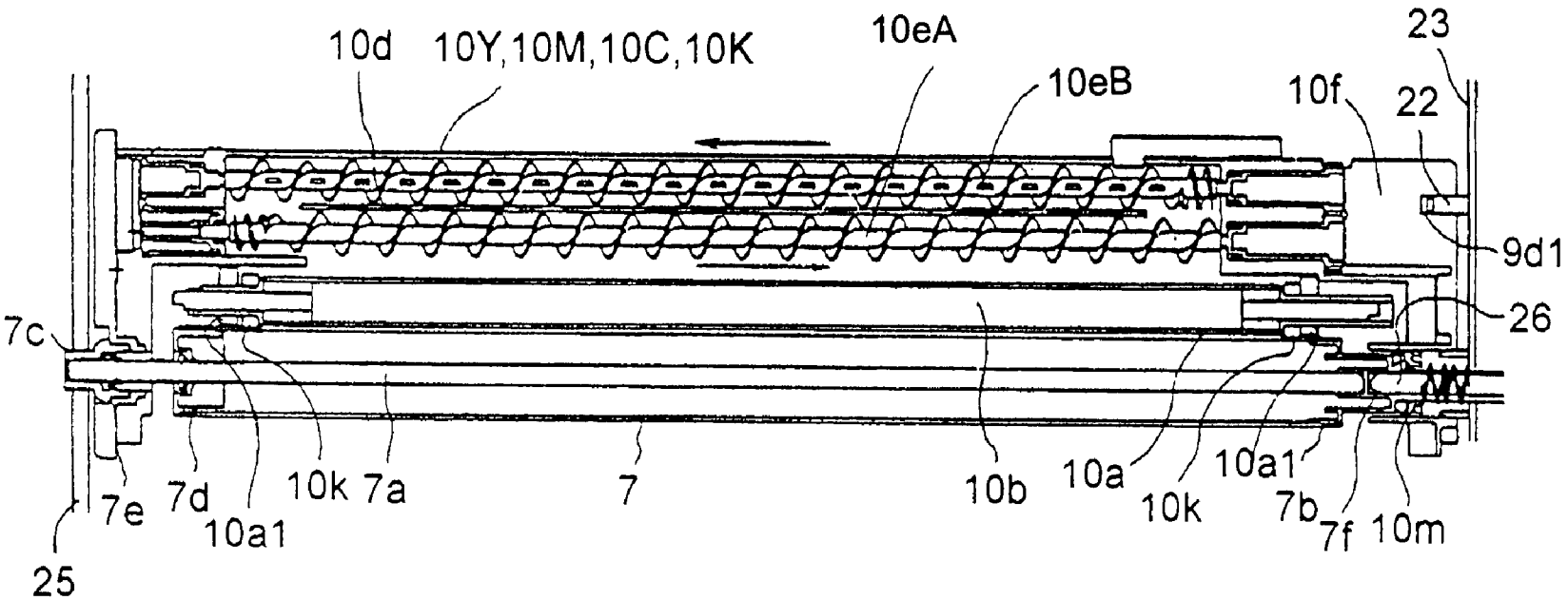
FIG. 4 is a horizontal, lengthwise sectional view of the process cartridge in the preferred embodiment of the present invention.

Referring to FIG. 4, the sleeve 10*a* is provided with a pair of ring-shaped spacers 10*k*, which are rotatably fitted around the journal portions 10*a*1, that is, the lengthwise end portions of the sleeve 10*a*, one for one. With the provision of the spacers 10*k*, a predetermined gap is maintained between the sleeve 10*a* and photoconductive drum 7 so that during a development operation, only the developer layer formed on the peripheral surface of the sleeve 10*a* touches the photoconductive drum 7. The sleeve 10*a* is rotationally driven in the direction indicated by an arrow mark, that is, in the direction counter to the rotational direction of the photoconductive drum 7, at a predetermined peripheral velocity.

The toner in this embodiment is such toner that is negative in inherent polarity and is 6 $\mu$m in average particle diameter. The magnetic carrier in this embodiment is 205 emu/cm$^3$ in saturation magnetization, and is 35 $\mu$m in average particle diameter. The ratio in weight between the toner and carrier in the developer is 6:94.

The developer storage portion 10*h*, in which the developer is circulated, has two chambers divided by a partitioning wall 10*d* which extends in the lengthwise direction. The developer storage portion 10*h* has stirring screws 10*e*A and 10*e*B, which are disposed on both sides of the partitioning wall 10*d*, one for one.

Referring to FIG. 4, as the toner is supplied to the developer storage portion 10*h* from the developer supply container, the toner falls onto the back end portion (right end portion) of the stirring screw 10*e*B, and is conveyed frontward (left end portion) of the apparatus, in terms of the lengthwise direction, while being stirred. Then, it is moved through the gap between the front wall of the developer storage portion 10*h* and the partitioning wall 10*d*, and then, is conveyed backward of the developer storage portion 10*h*, in terms of the lengthwise direction, by the stirring screw 10*e*A. Then, it is moved through the gap between the back wall of the developer storage portion 10*h* and the partitioning wall 10*d*. In other words, the developer is repeatedly circulated by the stirring screws 10*e*B and 10*e*A in the developer storage portion 10*h*. The front side means the side where the developing sleeve positioning plate 25 is present, and the back side means the side where the rear wall 23 is present.

At this time, the development process for developing an electrostatic latent image formed on the photoconductive drum 7 into a visible image with the use of the process cartridges 10Y, 10M, 10C, or 10K, which employs a two-component magnetic brush developing method, and the developer circulating system, will be described.

As the sleeve 10*a* is rotated, the developer in the developer storage portion 10*h* is picked up and held to the peripheral surface of the sleeve 10*a*, by the pickup pole of the magnetic roller 10*b*, and is conveyed further.

While being conveyed after being held to the peripheral surface of the sleeve 10*a*, the body of developer is regulated in thickness by the development blade 10*c* disposed perpendicular to the peripheral surface of the sleeve 10*a*. As a result, a thin layer of developer is formed on the peripheral surface of the sleeve 10*a*. As the thin layer of developer reaches the development portion, which corresponds in position to the development pole of the magnetic roller 10*b*, the developer layer is made to crest by the magnetic force. Thus, the electrostatic latent image on the peripheral surface of the photoconductive drum 7 is developed into a visible image, by the toner in the crest of the developer layer. Incidentally, in this embodiment, an electrostatic latent image is developed in reverse.

After being conveyed and passed through the development portion, the thin layer of developer on the peripheral surface of the sleeve 10*a* is made to enter the developer storage portion, by the subsequent continual rotation of the sleeve 10*a*. In the developer storage portion, the developer layer is made to separate from the peripheral surface of the sleeve 10*a*, by the repulsive magnetic field of the conveyance pole, and fall into the developer storage portion. In other words, it is returned to the developer bed in the developing means housing.

To the sleeve 10*a*, a combination of DC voltage and AC voltage is applied from an unshown electrical power source. In this embodiment, the combination of a DC voltage of −500 V and an AC voltage which is 2,000 Hz in frequency, and 1,500 V in peak-to-peak voltage, is applied to develop only the exposed points of the peripheral surface of the photoconductive drum 7.

Generally, in a two-component developing method, the application of AC voltage increases development efficiency, making it possible to form an image of higher quality. On the other hand, the application of AC voltage is likely to result in the formation of a foggy image. Therefore, it is a common practice to create a certain amount of difference in potential level between the potential level of the DC voltage applied to the sleeve 10*a* and the potential level of the peripheral surface of the photoconductive drum 7 in order to prevent the formation of a foggy image. More specifically, bias voltage, the potential level of which falls between the potential level of an exposed point of the peripheral surface of the photoconductive drum 7, and the potential level of an unexposed point of the peripheral surface of the photoconductive drum 7, is applied.

As the toner is consumed by the development of an electrostatic latent image, the toner content of the developer decreases. In this embodiment, a sensor 10*g* for detecting the toner content is disposed in the adjacencies of the peripheral surface of a developer stirring screw 10*e*B. As it is detected by the sensor 10*g* that the toner content of the developer has reduced below a predetermined level, a command for supplying the process cartridge 10 with the toner from the toner supply container 12 is issued to initiate a toner supplying operation. This toner supplying operation maintains the toner content of the developer in the developing apparatus at a predetermined level.

[Toner Supply Container]

Next, referring to FIGS. 1–3, and 5–7, the toner supply container 12 in the preferred embodiment of the present invention will be described.

Figure 3:
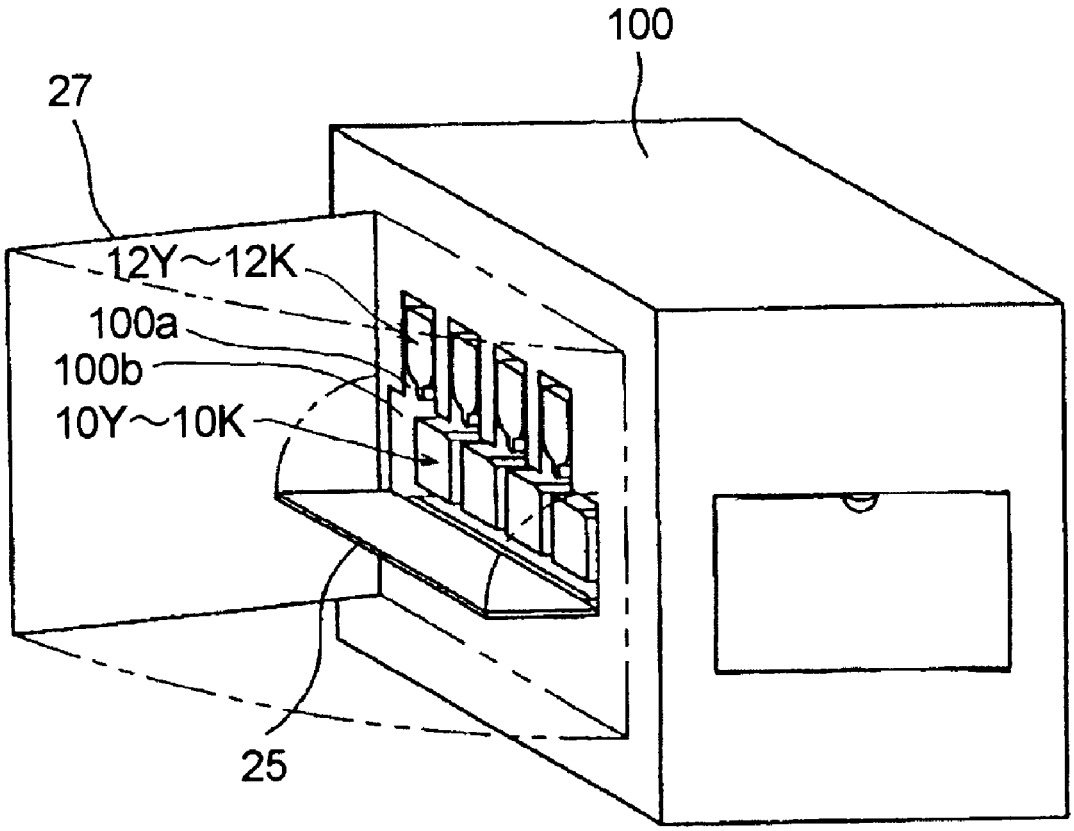
FIG. 3 is a schematic external perspective view of the image forming apparatus in the preferred embodiment of the present invention.

The toner supply containers 12Y, 12M, 12C, and 12K are disposed in parallel in the direction perpendicular to the recording medium conveyance direction, and aligned in the recording medium conveyance direction, being positioned above the cartridges 10Y, 10M, 10C, and 10K, respectively. They are mounted into the apparatus main assembly 100, from the front side thereof (FIG. 3).

Figure 5:
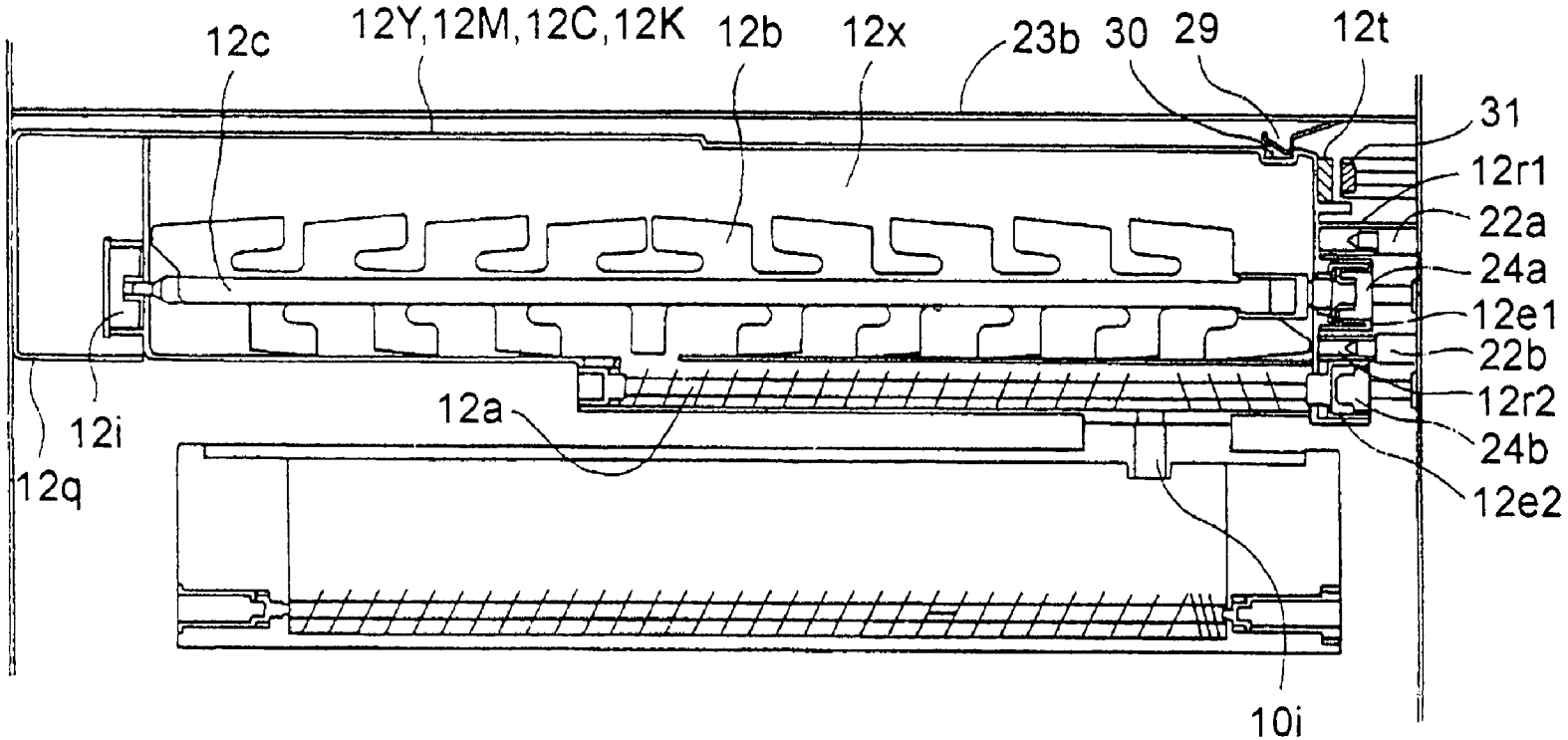
FIG. 5 is a vertical, lengthwise sectional view of the toner supply container and process cartridge, in the preferred embodiment of the present invention.

Referring to FIGS. 2 and 5, the toner supply containers 12Y, 12M, 12C, and 13K each have a frame 12*r*, and a toner storage portion 12*x* for storing toner. The toner storage portion 12*x* is within the frame 12*r*. Within the toner storage portion 12*x*, a stirring plate 12*b* solidly fixed to a stirring shaft 12*c*, and a screw 12*a* as a conveying means, are disposed. The bottom wall of the toner supply container 12 is provided with a toner outlet 12*f* having a developer releasing hole through which the toner is discharged.

The screw 12*a* and stirring shaft 12*c* are rotatably supported by the toner supply container 12, by their lengthwise ends. The screw 12*a* is provided with a driving coupling (female coupling) 12*e*1, which is attached to one end of the screw 12*a*, and the stirring shaft 12*c* is provided with a driving coupling (female coupling) 12*e*2, which is attached to one end of the stirring shaft 12*c*. The driving couplings (female couplings) 12*e*1 and 12*e*2 receive the driving force transmitted through the driving couplings (male couplings) 24*a* and 24*b*, one for one, of the image forming apparatus 100, being thereby rotationally driven.

The screw 12*a* comprises two pieces of spiral ribs located on one side of the toner outlet 12*f* and the other, in term of the lengthwise direction of the screw 12*a*, and twisted in the opposite direction (FIG. 5). The screw 12*a* is rotated in the predetermined direction by the rotation of the driving coupling (male coupling) 24*b*. As a result, the toner is conveyed toward the toner outlet 12*f*, and free falls through the toner releasing hole 12*f*3*b* of the toner outlet 12*f* into the corresponding process cartridge 10 (10Y, 10M, 10C, or 10K); in other words, the process cartridge 10 (10Y, 10M, 10C, or 10K) is supplied with the toner.

The peripheral edge, that is, the outermost edge of each section of the stirring plate 12*b*, in terms of the rotational radius of the developer sending member 12*b*, is angled relative to the stirring shaft 12*c* (FIG. 5). Thus, as each section of the stirring plate 12*b* rubs against the internal surface of the toner supply container 12 (12Y, 12M, 12C, or 12K), more specifically, the internal surface of the toner storage portion 12*x*, its peripheral edge portion is arcuately bent relative to its base portion. More specifically, the peripheral edge portion of each section of the stirring plate 12*b* is spirally twisted. Thus, as the stirring shaft 12*c* is rotated, the toner in the toner supply container 12 comes into contact with the spirally twisted edge portions of the stirring plate 12*c*, being thereby conveyed in the lengthwise direction of the stirring shaft 12*c*.

To theorize the manner in which the amount of the toner in the toner supply container 12 (12Y, 12M, 12C, and 12K) reduces, the toner is discharged primarily from the adjacencies of the aforementioned developer outlet 12*f*, creating thereby an inverse conical hole in the body of toner in the toner supply container 12; the toner is not uniformly supplied from the entire range of the toner supply container 12. Uneven toner reduction such as the above described one is not desirable for discharging the toner from the toner supply container 12 at a constant rate.

In this embodiment, however, the toner is conveyed by the stirring plate to the toner outlet 12*f* as described before. Therefore, the toner is discharged at a constant rate.

Each of the development supply containers 12 (12Y, 12M, 12C, and 12K) is provided with an IC memory unit 12*t*, in which the data regarding the toner supply container and the main assembly of the developing apparatus, are stored, making possible the data communication between the communication control board 31 on the main assembly side, and the toner supply container 12.

Not only can the toner supply container 12 in this embodiment supply toner to a process cartridge, or a development cartridge, based on a two-component developing method, but also to a process cartridge or a development cartridge based on a single-component developing method. Further, the powder to be stored in the toner supply container 12 does not need to be limited to toner. For example, it may be the so-called developer, that is, a mixture of toner and magnetic carrier, which is needless to say.

Figure 6:
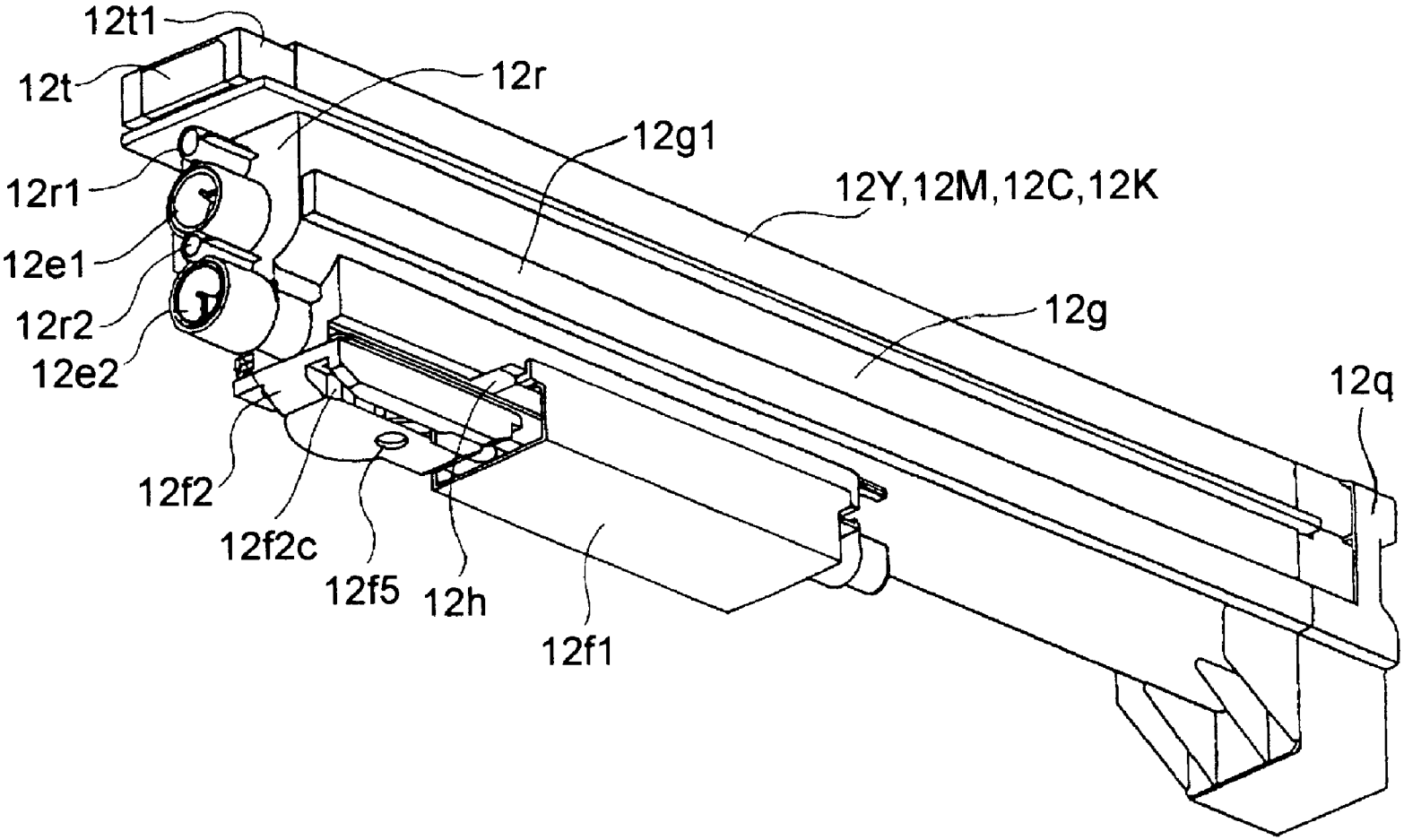
FIG. 6 is a perspective view of the toner supply container in the preferred embodiment of the present invention.
Figure 7:
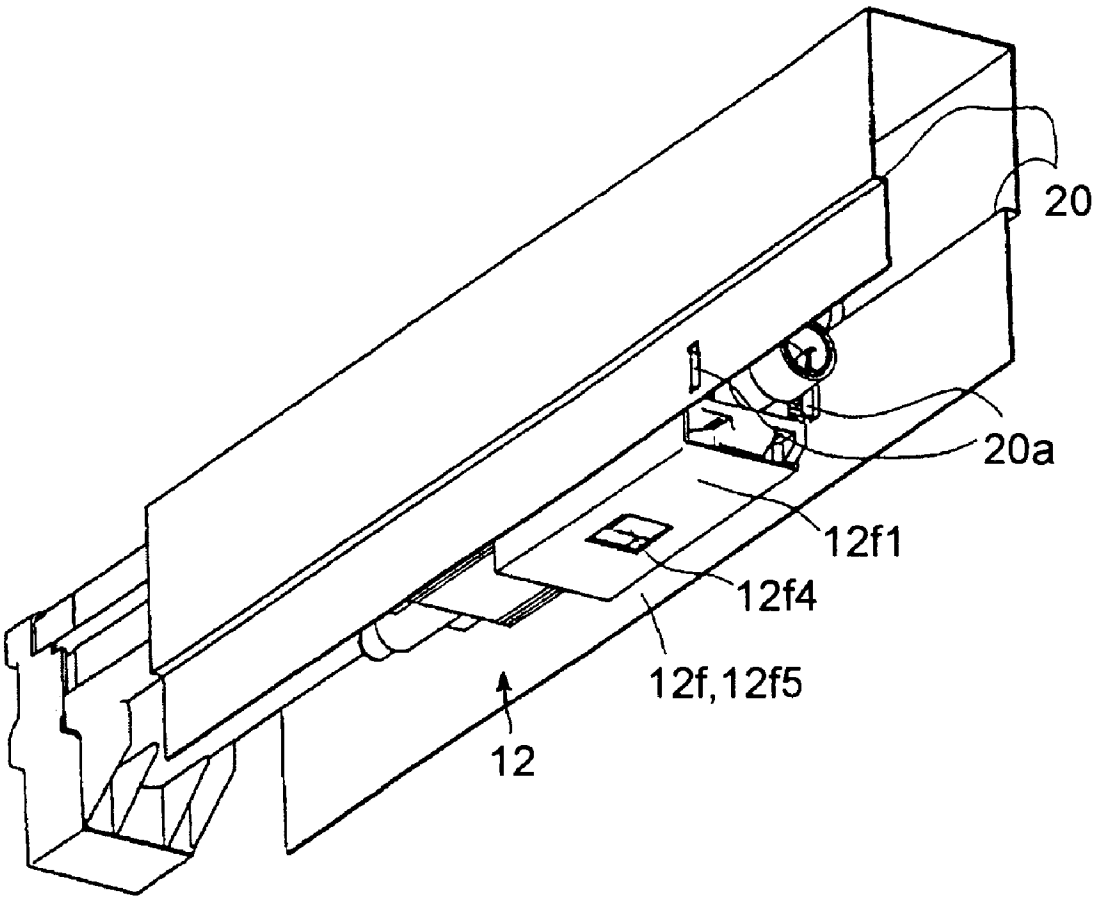
FIG. 7 is a perspective view of the toner supply container, and the rails, on the main assembly side of the image forming apparatus, for supporting the toner supply container.
Figure 8:
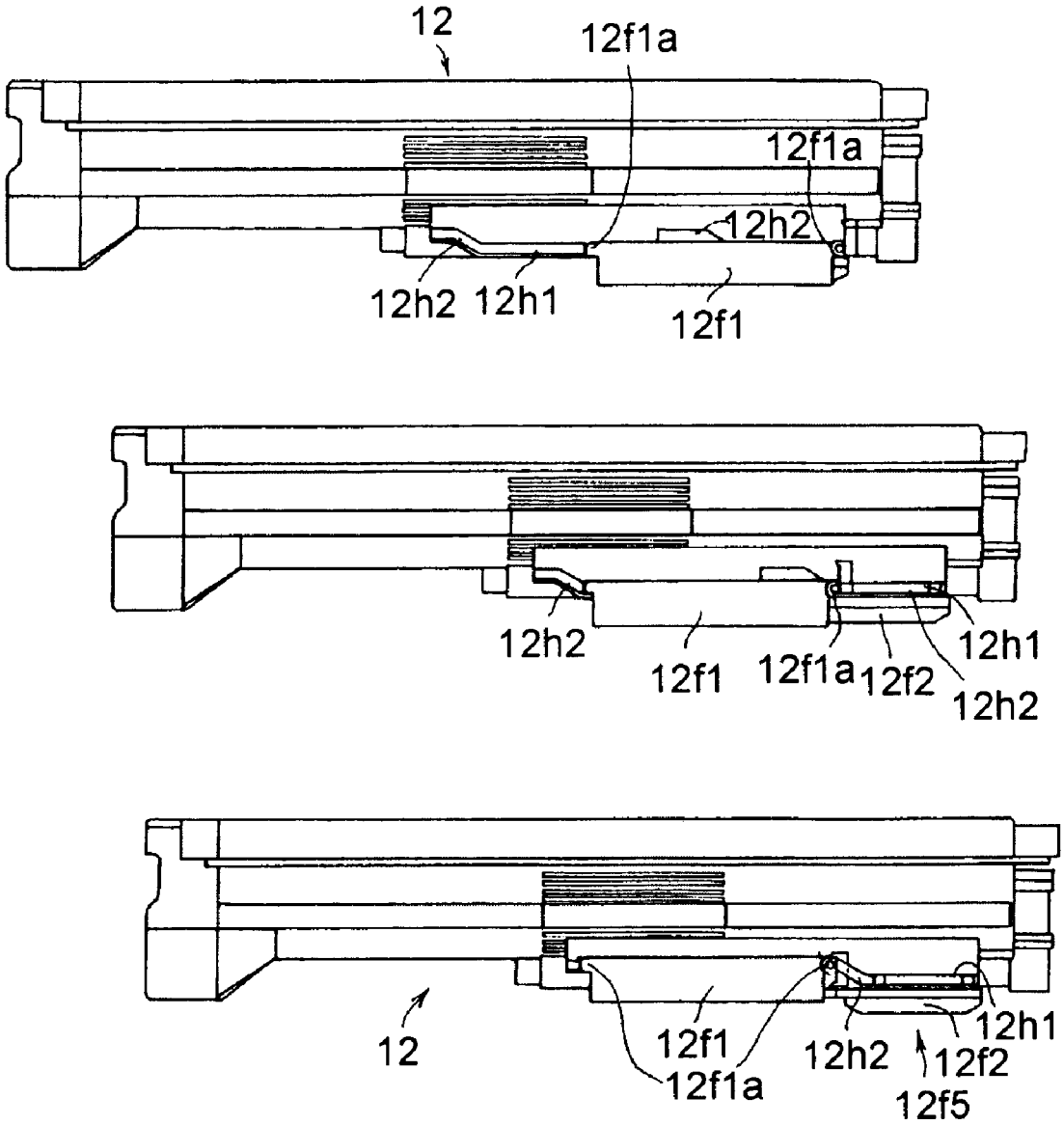
FIG. 8 is a multi-sequence side view of the toner supply container in the preferred embodiment of the present invention, as seen from the direction perpendicular to the lengthwise direction of the toner supply container, for showing the movement of the toner outlet cover.

FIGS. 6–9 are perspective views of the toner supply container 12 as seen from below the back end thereof. Referring to FIG. 6, the frame 12*g* of the toner supply container 12 is provided with a pair of guiding portions 12*g*1, which function as guides when the toner supply container 12 is inserted into the image forming apparatus 100. The toner supply container 12 is also provided with a movable toner outlet cover 12*f*1 for covering the opening of the toner outlet 12*f* located at the bottom of the toner supply container 12. The latching portions 12*f*1*a* of the outlet cover 12*f*1 are engaged with the rails 12*h* of the toner supply container 12 (FIG. 8).

Before the mounting of the toner supply container 12 into the image forming apparatus 100, the outlet cover 12*f*1 is in the first position in which it covers the opening of the outlet 12*f* of the toner supply container 12.

As the toner supply container 12 is inserted into the image forming apparatus 100, the guide rails 20 of the image forming apparatus 100 and the guiding portions 12*g*1 of the toner supply container 12 slide against each other. During this insertion of the toner supply container 12, the leading end of the toner outlet cover 12*f*1, in terms of the toner supply container insertion direction, comes into contact with the projection 20*a* of each guide rail 20, as shown in FIG. 7. As the toner supply container 12 is further inserted from the point of contact between the toner outlet cover 12*f*1 and projection 20*a*, the toner outlet cover 12*f*1 is kept stationary by the projections 20*a* even though the main assembly of the toner supply container 12 is further inserted. In other words, the toner outlet cover 12*f*1 is moved backward, in terms of the toner supply container insertion direction, relative to the main assembly of the toner supply container 12, along the rails 12*h* of the toner supply container 12. Eventually, the outlet cover 12*f*1 reaches the second position in which it exposes an outlet cover retaining member 12*f*2 which is placed in contact with the cartridge 10 in order to connect the toner supply container 12 with the cartridge 10.

Next, referring to FIG. 8, the above described aspect of the toner supply container insertion will be further described in detail. FIG. 8 is a multi-sequence side view of the toner supply container 12 in the preferred embodiment of the present invention, as seen from the direction perpendicular to the lengthwise direction of the toner supply container, for showing the changes in position of the toner outlet cover 12*f*1 relative to the main assembly of the toner supply container 12. With the progress of the insertion of the toner supply container 12, the outlet cover 12*f*1 sequentially moves from the position shown in the top drawing of FIG. 8 to the one shown in the middle drawing of FIG. 8, and then, to the one shown in the bottom drawing of FIG. 8.

After coming into contact with the projections 20*a*, the toner outlet cover 12*f*1 is slid virtually horizontally along the first section 12*h*1 of each rail 12*h*. Then, it is slid along the second section 12*h*2 of each rail 12*h*, being thereby moved upward, that is, in the direction to move away from the process cartridge 10, until it fully exposes the retaining member 12*f*2.

In reality, during the insertion of the toner supply container 12 into the image forming apparatus 100, the toner outlet cover 12*f*1 does not move in the roughly horizontal direction. In fact, it simply retracts upward by being guided by the second section 12*h*2 of each rail 12*h*.

Figure 10:
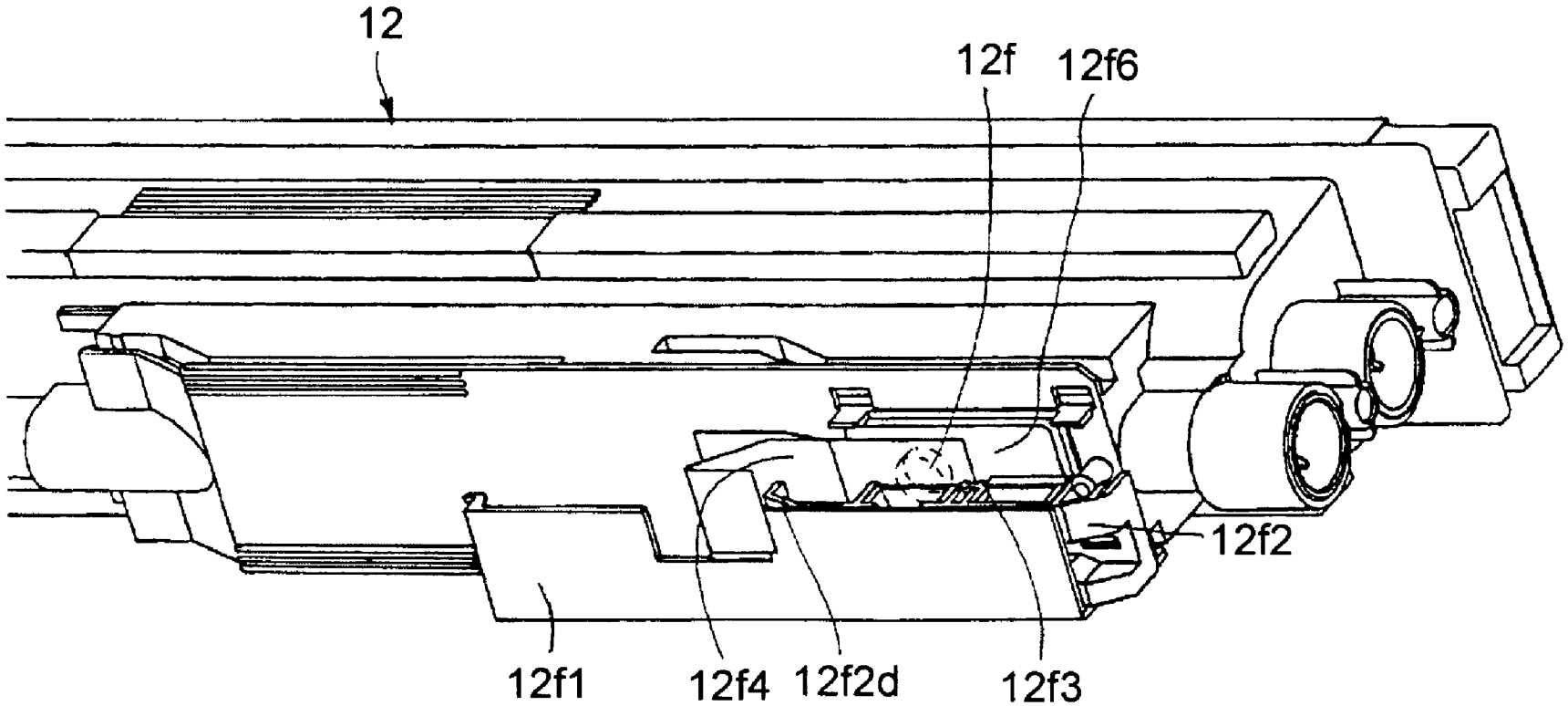
FIG. 10 is a partially broken perspective view of the toner outlet cover (closed), and outlet sealing tape of the toner supply container in the preferred embodiment of the present invention, for showing the structures thereof.

Referring to FIG. 10, etc., to the bottom wall of the toner supply container 12, the toner outlet 12*f* for discharging the toner in the toner supply container 12 is attached. In this embodiment, the outlet 12*f* is on back side of the container, that is, the side from which driving force is transmitted to the screw 12*a*.

The bottom wall of the toner supply container 12 is also provided with an outlet shutter 12*f*3 for shutting or opening the toner outlet 12*f*, and the shutter retaining member 12*f*2 which has the function of preventing the toner outlet shutter 12*f* from falling down, and the function of connecting the toner outlet 12*f* of the toner supply container 12 with the toner inlet of the cartridge 10. This retaining member 12*f*2 is provided with toner discharge hole 12*f*5.

With the provision of the above described structural arrangement, the toner is discharged through the toner outlet 12*f*, and is supplied to the cartridge 10 after passing through the hole of the shutter 12*f*3, and the toner discharge hole 12*f*5 of the retaining member 12*f*2.

Figure 9:
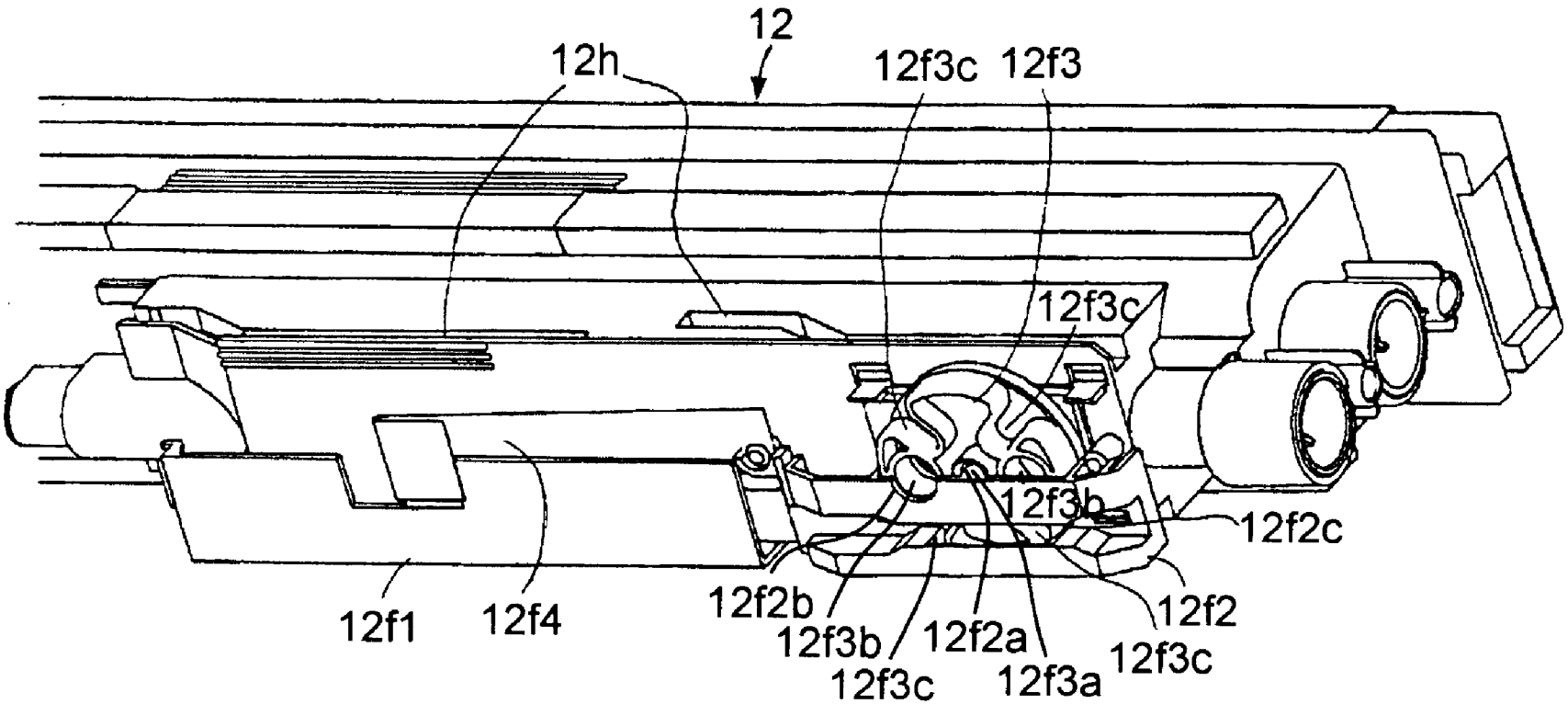
FIG. 9 is a partially broken perspective view of the toner outlet shutter, and its adjacencies, of the toner supply container in the preferred embodiment of the present invention.

FIG. 9 is an enlarged perspective view of the outlet cover 12*f*1 and shutter 12*f*3 of the toner supply container 12, with the shutter 12*f*3 being in the open position, as seen from below the back end of the toner supply container 12. For the ease of visual comprehension, the right half of the toner outlet cover 12*f*1, and the right half of the retaining member 12*f*2, as seen from the trailing side of the toner supply container 12 in terms of the toner supply container insertion direction, have been left out.

As shown in FIG. 9, the shutter 12*f*3 is provided with the center hole 12*f*3*a*, about the axial line of which the shutter 12*f*3 is rotated. The shutter 12*f*3 is also provided with two holes 12*f*3*b* symmetrically positioned with respect to the axial line of the center hole 12*f*3*a*, and four slots 12*f*3*c*, which are 45° apart from the adjacent hole 12*f*3*b* in terms of rotational phase of the shutter 12*f*3, and in which the projections of the cartridge 10 fit to rotate the shutter 12*f*3.

The retaining member 12*f*2 is provided with a pin 12*f*2*a* with which the retaining member 12*f*2 rotationally supports the shutter 12*f*3 so that the shutter 12*f*3 rotates about the pin 12*f*2*a*, and a through hole 12*f*2*b* through which the toner is supplied, and an elongated hole 12*f*2*c* which extends practically straight in the lengthwise direction of the retaining member 12*f*2. The retaining member 12*f*2 is attached to the toner supply container 12 so that it is allowed to slightly move relative to the toner supply container 12 in the vertical direction.

Figure 11:
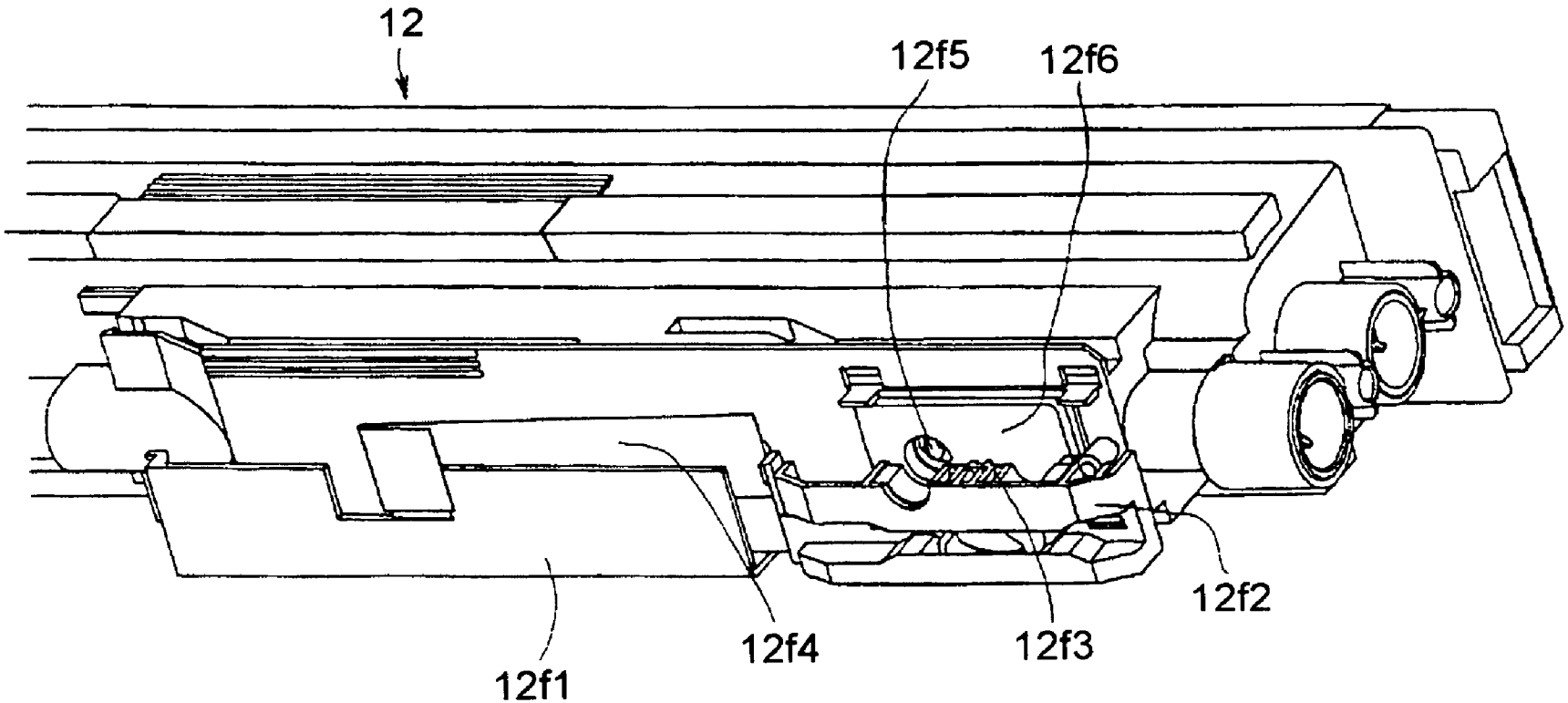
FIG. 11 is a partially broken perspective view of the toner outlet cover (open), and outlet sealing tape of the toner supply container in the preferred embodiment of the present invention, for showing the structures thereof.

There is disposed a sealing member 12*f*6 between the shutter 12*f*3 and the toner outlet 12*f* (FIGS. 10 and 11). The sealing member 12*f*6 seals between the adjacencies of the outlet 12*f* and the shutter 12*f*3, preventing thereby the toner from scattering outward when the shutter 12*f*3 is rotated.

The toner supply container 12 is also provided with the outlet cover 12*f*1, which is attached to the container 12 to cover or expose the above described shutter retaining member 12*f*2. More specifically, the cover 12*f*1 is latched to the rails 12*h* of the toner supply container 12, being enabled to retract rearward, in terms of the toner supply container insertion direction, relative to the main assembly of the container, and then, retracts upward.

Prior to the mounting of the toner supply container 12 into the image forming apparatus, the hole 12*f*3*b* of the shutter 12*f*3 is in the first position which is deviated by 90° in rotational phase from the outlet 12*f*. Therefore, the hole 12*f*5 remains blocked. The cover 12*f*1 is kept, by an unshown spring or the like, in the position in which the cover 12*f*1 covers the retaining member 12*f*2.

As the toner supply container 12 is inserted into the image forming apparatus 100, the unshown pin, with which the cartridge 10 is provided, fits into the aforementioned slot 12*f*3*c* of the shutter 12*f*3, causing the shutter 12*f*3 to rotate 90° to allow the toner to be discharged.

FIGS. 10 and 11 are enlarged perspective views of the shutter 12*f*3, cover 12*f*1, and their adjacencies, of the toner supply container 12 in the preferred embodiment of the present invention, as seen from below the back end of the toner supply container 12, showing their closed and open states, respectively. For the ease of visual comprehension, the right halves of the cover 12*f*1, retaining member 12*f*2, and shutter 12*f*3, in terms of the toner supply container insertion direction, have been left out.

Referring to FIG. 10, in which the cover 12*f*1 and shutter 12*f*3 are closed, there is the sealing member 12*f*6 glued to the adjacencies of the outlet 12*f*. The opening of the outlet 12*f* is sealed with a piece of peelable tape 12*f*4 pasted to the bottom surface of the frame 12*g*. After sealing the outlet 12*f*, the tape 12*f*4 is folded back at a point in the adjacencies of the outlet 12*f*, extended through a hole 12*f*2*d* of the retaining member 12*f*2, and fixed to the cover 12*f*1.

As the toner supply container 12 is inserted into the image forming apparatus 100 as described above, the cover 12*f*1 is moved relative to the toner supply container 12 along the rails 12*h*, in the direction to expose the outlet 12*f*. Thus, the tape 12*f*4 is peeled from the bottom wall, starting from the folding line, exposing the outlet 12*f*.

[Transferring Means]

The intermediary transfer unit 4, as a transferring means, is a unit for transferring (secondary transfer) all at once onto the recording medium 2 a plurality of toner images having been sequentially transferred in layers onto the intermediary transfer unit 4 from the photoconductive drum 7.

Referring to FIG. 1, the intermediary transferring unit 4 is provided with an intermediary transfer belt 4*a*, which runs in the clockwise direction indicated by an arrow mark at virtually the same peripheral velocity. The intermediary transfer belt 4*a* is an endless belt with a circumferential length of approximately 940 mm, and is suspended around three rollers: a driver roller 4*b*, a belt backing transfer roller 4*g*, and a follower roller 4*c*.

Within the loop of the intermediary transfer belt 4*a*, transfer charge rollers 4fY, 4fM, 4fC, and 4fK are rotatably disposed, opposing the corresponding photoconductive drums 7 with the presence of the intermediary transfer belt 4*a* between the transfer charge rollers 4fY, 4fM, 4fC, and 4fK and the corresponding photoconductive drums 7. Each transfer charge roller is kept pressured toward the center of the corresponding photoconductive drum 7.

The transfer charge rollers 4fY, 4fM, 4fC, and 4fK are supplied with power by an unshown high voltage power source, and charge the intermediary transfer belt 4*a* to the polarity opposite to that of the toner, from the inward side of the loop of the intermediary transfer belt 4*a*, in order to sequentially transfer (primary transfer) the toner images on the corresponding photoconductive drums 7 onto the outward surface of the intermediary transfer belt 4*a*.

In the secondary transfer portion, the secondary transfer roller 4*d* as a transferring member is kept pressed on the intermediary transfer belt 4*a*, opposing the belt backing transfer roller 4*g* with the presence of the intermediary transfer belt 4*a* between the secondary transfer roller 4*d* and belt backing transfer roller 4*g*. The secondary transfer roller 4*d* is movable in the vertical direction in FIG. 1, and is rotatable. During transfer, bias is continuously applied to the secondary transfer roller 4*d*, and therefore, the toner images on the intermediary transfer belt 4*a* are transferred onto the recording medium 2.

The intermediary transfer belt 4*a* and secondary transfer roller 4*d* are individually driven. As the recording medium 2 is entered into the secondary transfer portion, a predetermined bias is applied to the secondary transfer roller 4*d*. As a result, the toner images on the intermediary transfer belt 4*a* are transferred (secondary transfer) onto the recording medium 2.

During the transfer process, the recording medium 2 is conveyed leftward of FIG. 1 at a predetermined velocity, while remaining sandwiched between the secondary transfer roller 4*d* and intermediary transfer belt 4*a*, to a fixing device 5 which carries out the next process.

The image forming apparatus 100 is provided with a cleaning unit 11, which can be placed in contact with, or moved away from, the surface of the intermediary transfer belt 4*a*, and which is at a predetermined location in the adjacencies of the downstream end of the intermediary transfer belt 4*a* in terms of the direction in which the recording medium is conveyed during the transfer process. The cleaning unit 11 removes the secondary transfer residual toner, that is, the toner remaining on the intermediary transfer belt 4*a* after the secondary transfer.

Within the unit 11, a cleaning blade 11*a* for removing the secondary transfer residual toner is disposed. The cleaning unit 11 is attached to the main assembly of the image forming apparatus 100 so that it can be pivoted about an unshown pivotal axis. The blade 11*a* is kept pressed on the intermediary transfer belt 4*a*, being tilted so that the cleaning edge of the blade 11*a* is on the upstream side relative to the base portion of the blade 11*a* in terms of the moving direction of the intermediary transfer belt 4*a*. After being taken into the cleaning unit 11, the secondary transfer residual toner is conveyed by a screw 11*b* to a removed toner bin (unshown) and is stored therein.

[Fixing Portion]

A toner image formed on the photoconductive drum 7 by the developing means in the process cartridge 10 is transferred onto the recording medium 2 by way of intermediary transfer belt 4*a*. The fixing device 5 thermally fixes to the recording medium 2 the unfixed toner images, that is, the images having just been transferred onto the recording medium 2.

Also referring to FIG. 1, the fixing device 5 is provided with a fixing roller 5*a* for applying heat to the recording medium 2, and a pressure roller 5*b* for pressing the recording medium 2 against the fixing roller 5*a*. Both rollers 5*a* and 5*b* are hollow. Each roller contains a heater (unshown) in its hollow. They together convey the recording medium 2 as they are rotationally driven.

In other words, while the recording medium 2, which is bearing toner images, is conveyed by the fixing roller 5*a* and pressure roller 5*b*, heat and pressure are applied to the recording medium 2 and toner images by the rollers. As a result, the toner images are fixed to the recording medium 2. After the fixation, recording medium 2 is discharged out of the main assembly of the image forming apparatus 100 by two pairs 3*h* and 3*j* of discharge rollers, into a delivery tray 6 on top of the image forming apparatus 100, and is accumulated therein.

[Mounting of Process Cartridge and Toner Supply Container]

Next, referring to FIGS. 2, 3, and 5, the procedure for mounting the cartridge 10 and toner supply container 12 into the image forming apparatus 100 will be described.

Referring to FIG. 3, the image forming apparatus 100 is provided with a door 27, which is located in the front panel of the image forming apparatus 100 and can be freely opened or closed. As an operator opens the door 27 frontward, the opening 100*a* through which the process cartridges 10Y, 10M, 10C, and 1K, are inserted, and the opening 100*b*, through which, the toner supply containers 12Y, 12M, 12C, and 12K, are inserted, are exposed.

The opening 100*b* through which the process cartridges 10Y, 10M, 10C, and 10K are inserted are provided with the drum shaft positioning plate 25, which is rotatably supported. Thus, when inserting or removing the process cartridge 10Y, 10M, 10C, and 10K, this drum shaft positioning plate 25 must be opened and closed.

Referring to FIG. 2, in the image forming apparatus 100, four pairs of guiding rails 21 for guiding the process cartridge 10Y, 10M, 10C, and 10K when mounting them, and four pair of guiding rails 20 for guiding the toner supply containers 12Y, 12M, 12C, and 12K when mounting them, are provided.

The directions in which the cartridges 10Y, 10M, 10C, and 10K and toner supply containers 12Y, 12M, 12C, and 12K are mounted into the image forming apparatus 100 are parallel to the axial line of the photoconductive drum 7, and the axial direction of the screw 12*a*, respectively, and so are the directions in which the guiding rails 21 and 20 extend.

The process cartridges 10Y, 10M, 10C, and 10K, and toner supply containers 12Y, 12M, 12C, and 12K are inserted into the image forming apparatus 100, from the front side of the image forming apparatus 100, and then, are slid deeper into the image forming apparatus 100 along the guiding rails 21 and 20.

Referring to FIG. 4, as the process cartridge 10Y, 10M, 10C, or 10K reaches the deepest end of the image forming apparatus 100, the drum positioning shaft 26 of the image forming apparatus 100 enters the center hole of the drum flange 7*b*. As a result, the rotational axis of the back end of the photoconductive drum 7 is accurately positioned relative to the image forming apparatus 100. At the same time, the drum flange 7*b* engages with the driving coupling 10*m*, making it possible for the photoconductive drum 7 to be rotationally driven. Also, the rear wall 23 of the image forming apparatus 100 is provided with four cartridge supporting pins 22 for accurately positioning the process cartridges 10Y, 10M, 10C, and 10K, one for one. Each cartridge supporting pin 22 enters the recess 9*d*1 of the frame 10*f* of the inserted process cartridge 10, whereby the frame 10*f* of the process cartridge 10 is accurately fixed in its position relative to the image forming apparatus 100.

On the front side of the image forming apparatus 100, the drum shaft positioning plate 25, which is rotationally opened or closed, is disposed, and with which the bearing cases 7*c* of the process cartridges 10Y, 10M, 10C, and 10K are solidly engaged. Through the above described process cartridge insertion sequence, the photoconductive drums 7 and process cartridges 10Y, 10M, 10C, and 10K are accurately positioned relative to the image forming apparatus 100.

In other words, the drum shaft 7*a*, drum flange 7*b*, recess 9*d*1, and bearing case 7*c* together constitute a positioning portion for positioning the cartridge 10Y, 10M, 10C, or 10K relative to the main assembly 100.

In comparison, referring to FIG. 5, as the toner supply container 12 (12Y, 12M, 12C, or 12K) is inserted into the deepest end, a supporting pin 22*a* projecting from the rear wall 23 of the apparatus main assembly 100 enters the hollow cylindrical portion 12*r*1 projecting from the rear wall 12*r* of the frame 12*g* of the toner supply container 12. In terms of a cross sectional view parallel to the rear wall 12*r* of the frame 12*g*, the hollow cylindrical portion 12*r*1 is elongated in the vertical direction. Therefore, as the supporting pin 22*a* enters the cylindrical portion 12*r*1, the position of the toner supply container 12 (12Y, 12M, 12C, or 12K) becomes fixed in terms of the horizontal direction. Similarly, a supporting pin 22*b* projecting from the rear wall 23 enters the hollow cylindrical portion 12*r*2 projecting from the rear wall 12*r* of the frame 12*g* of the toner supply container 12, preventing thereby the toner supply container 12 (12Y, 12M, 12C, or 12K) from rotating. Through the above described processes, the frame 12*r* of the toner supply container 12 (12Y, 12M, 12C, or 12K) is fixed in position. At the same time as the pins 22*a* and 22*b* enter the corresponding holes, the driving couplings (female) 12*e*1 and 12*e*2 couple with the driving couplings (male) 24*a* and 24*b*, respectively, making it possible for the screw 12*a* and stirring shaft 12*c* to be rotationally driven.

As for the positioning of the toner supply container relative to the apparatus main assembly 100 in terms of the toner supply container insertion direction, the top wall 23*b* of the toner supply container slot in the apparatus main assembly 100 is provided with a plate spring 29, and the top wall of the toner supply container 12 is provided with a container positioning portion 30. Thus, as the toner supply container 12 is inserted into the toner supply container slot, the plate spring 29 snaps into the container positioning portion 30, not only accurately positioning the toner supply container 12 in terms of the container insertion direction, but also, pressing by its resiliency the toner outlet 12*f* of the toner supply container 12 against the toner inlet 10*i* of the cartridge 10.

In summary, the toner supply container 12 (12Y, 12M, 12C, or 12K) is accurately positioned relative to the apparatus main assembly 100 by the combination of supporting pins 22*a* and 22*b*, and the holes 12*r*1 and 12*r*2, and the force for driving the toner supply container 12 is transmitted thereto by the combinations of the driving couplings (female) 12*e*1 and 12*e*2, and driving couplings (male) 24*a* and 24*b*, respectively.

[Remanufacturing Method for Toner Supply Container]

Next, the remanufacturing method, inclusive of the disassembling of the toner supply container 12, for the toner supply container 12 in the preferred embodiment of the present invention will be described with reference with the appended drawings, in particular, FIGS. 9–13.

The toner supply container 12 in this embodiment is provided with a toner inlet 12*j*, which is located in one of the lengthwise ends of the container 12. This toner inlet 12*j* is plugged with a capping member 12*i*. In this embodiment, the toner supply container 12 is also provided with a capping member covering member 12*q*, for the purpose of preventing the capping member 12*i* from becoming unplugged, making it difficult for a user to unplug the capping member to prevent the problem that the capping member 12*i* is accidentally removed by the user, or the like problems.

The capping member covering member 12*q* in this embodiment is fixed to the main assembly of the toner supply container 12 by welding (thermal crimping). One of the reasons for using this fixing means is for simplifying the process for assembling the toner supply container 12, and also, reducing toner supply container cost, by eliminating the connective members, that is, by reducing the component count. Another reason for using welding instead of providing the toner supply container 12 with connective claws or the like is for strengthening the toner supply container 12 to prevent the toner supply container 12 from being damaged when it is accidentally dropped, or in the like situations.

[Step for Removing Capping Member Covering Member]

Figure 12:
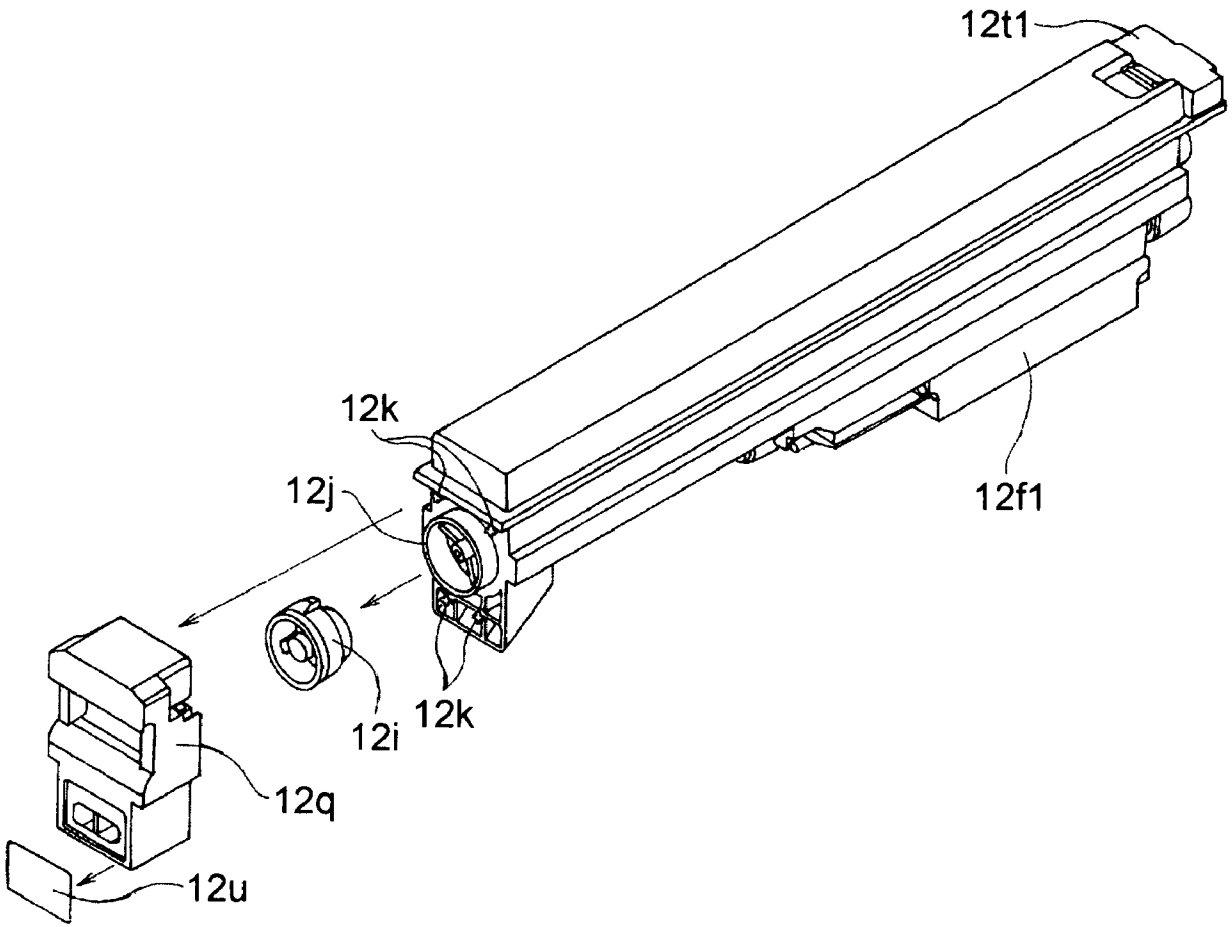
FIG. 12 is a partially exploded perspective view of the toner supply container in the preferred embodiment of the present invention.
Figure 13:
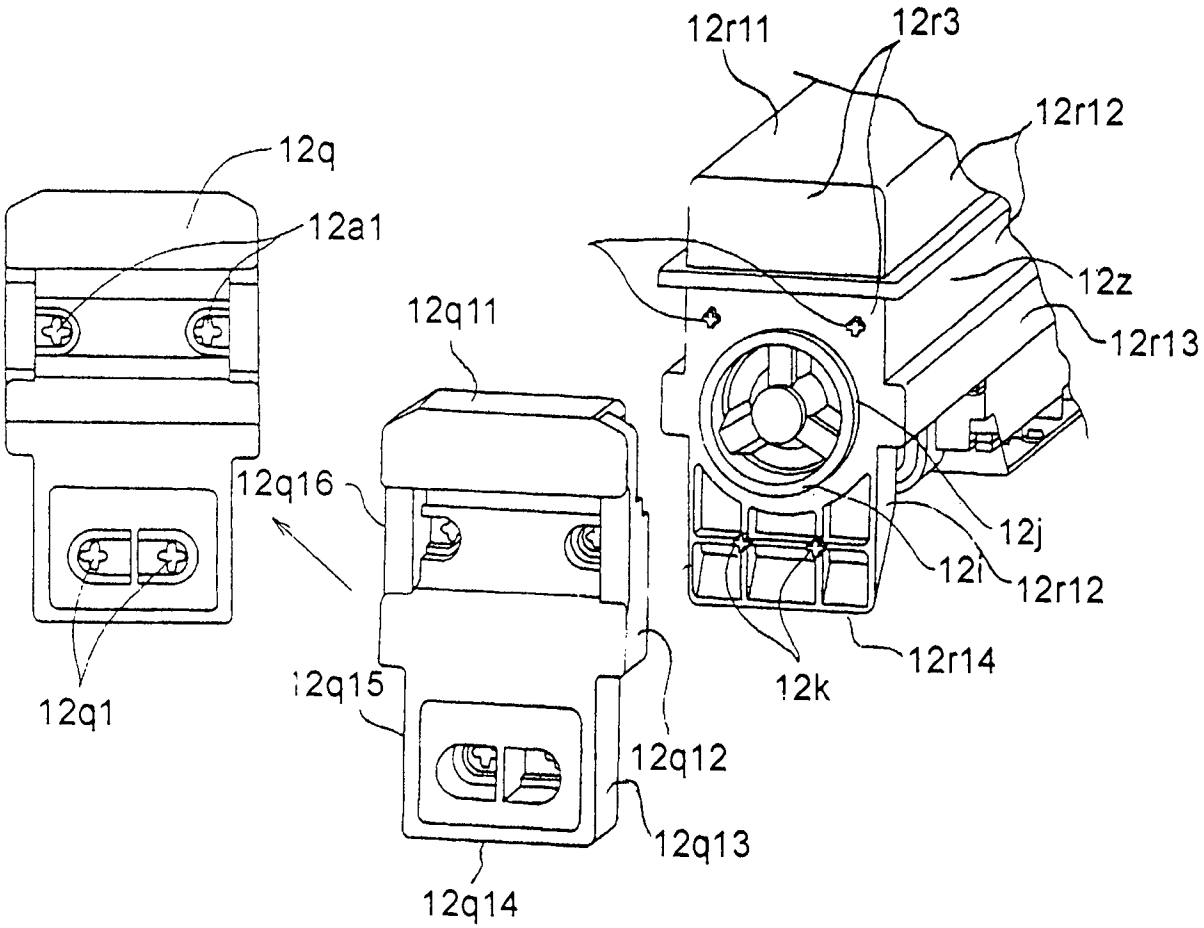
FIG. 13 is also a partially exploded perspective view of the toner supply container in the preferred embodiment of the present invention.

Referring to FIGS. 12 and 13, the toner supply container 12 is provided with a pair of projections 12*k*, which are fitted in the holes 12*q*1 of the capping member covering member 12*q*, one for one, with the tip portion of each projection 12*k* thermally crimped (tip portion of projection 12*k* is thermally deformed). In other words, the capping member covering member 12*q* is solidly fixed to one of the lengthwise ends of the toner supply container 12, by thermally deforming the tip portion of each projection 12*k*.

Figure 14:
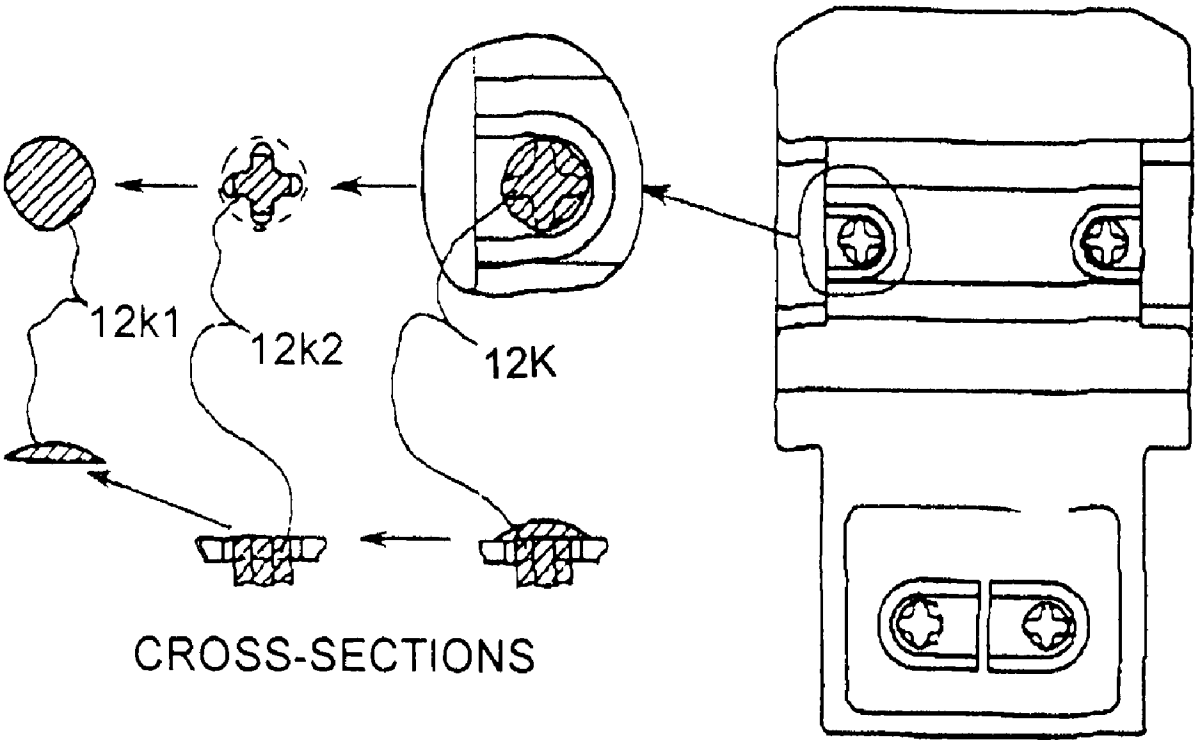
FIG. 14 is a drawing for describing how the capping member covering member of a toner supply container is solidly fixed to the frame of the toner supply container by crimping, in the preferred embodiment of the present invention.

The shape into which the projections 12*k* for keeping the capping member covering member 12*q* solidly attached to the toner supply container unit 12*z* are crimped is shown in FIG. 14. As the method for removing the capping member covering member 12*q*, there is a method in which the crimped portion 12*k*1 (tip portion of projection 12*k*, which had solidified after being melted), that is, the deformed tip portion 12*k*1 of the projection 12*k*, which is in contact with the top edge of the hole 12*q*1 of the capping member covering member 12*q*, is removed or destroyed with the use of an end mill cutter, a cutter, a nipper, or the like, or a method in which the projection 12*k* is pried out of the hole 12*q*1 by placing a tool with a narrow tip, for example, a flat-head screw driver, between the capping member covering member 12*q* and the end wall 12*r*3 of the toner supply container 12, while deforming the crimped portion 12*k*1 by heating the crimped portion 12*k*1. With the use of one of the above described methods, it is possible to remove or destroy only the crimped portion 12*k*1, making it possible to leave the capping member covering member 12*q* and the remaining portion 12*k*2 of the projection 12*k* in the state in which the capping member covering member 12*q* can be accurately positioned relative to the toner supply container unit 12*z*, because the crimped portion 12*k*1 can be cut off so that the resultant top end of the projection 12*k* becomes level with the outward surface of the capping member covering member 12*q*. There is also a method in which the capping member covering member 12*q* is pried away from the toner supply container unit 12*z* while destroying the crimped portion 12*k*1 by forcefully placing a tool with a narrow tip, for example, a flat-head screw driver, between the capping member covering member 12*q* and the end wall 12*r*3 of the toner supply container 12.

Incidentally, when the crimped portion 12*k*1 is covered with a labeling member 12*u* pasted to prevent the crimped portion 12*k*1 from remaining exposed (to prevent crimped portion 12*k*1 from remaining visible), the above described capping member covering member removal processes are to be carried out after the removal of this labeling member 12*u*.

(Step for Removing Capping Member)

Referring to FIG. 13, the capping member 12*i* is solidly attached to the toner supply container 12 by being plugged in the toner inlet 12*j* of the toner supply container 12.

In the capping member removing process, the capping member 12*i* is simply pulled out.

(Step for Cleaning Toner Supply Container)

After the removal of the capping member 12*i*, the toner supply container 12 is cleaned; a small amount of toner remaining in the toner storage portion 12*x* of the toner supply container 12 should be removed. Without the presence of the capping member 12*i* in the opening of the toner inlet 12*j*, which is quite large, it is easy to remove the toner remaining in the toner storage portion 12*x*.

In the process for cleaning the toner supply container, the toner is vacuumed out of the toner storage portion 12*x*, or is blown out with compressed air. The compressed air may be sent into the toner supply container 12 while suctioning air therefrom. This method is preferable because not only does it prevent the toner from scattering, but also make it possible to remove the toner much more quickly.

(Step for Sealing Toner Outlet of Toner Supply Container)

In the process for sealing the toner outlet 12*f* of the toner supply container 12, first, the components in the adjacencies of the outlet 12*f* must be disassembled. Thus, first, the outlet cover 12*f*1 shown in FIGS. 9–11 is removed from the toner supply container unit 12*z*, and then, the retaining member 12*f*2 is removed. Then, the adjacencies of the outlet 12*f* are cleaned with the use of such a cleaning method as vacuuming, blowing with compressed air, or wiping with alcohol or the like.

After the cleaning, the tape 12*f*4 is pasted to the toner supply container 12 in a manner to seal the toner outlet 12*f*. As for the method for attaching the tape 12*f*4, an ordinary glue, a hot-melt glue, a two-sided adhesive tape, or the like may be used. In addition, the tape 12*f*4 may be thermally welded to the toner supply container 12.

After the sealing of the outlet 12*f*, the processes carried out to disassemble the toner supply container 12 are carried out in the reverse order. That is, the outlet shutter 12*f*3 is positioned so that the tape 12*f*4 is folded back and sandwiched between the outlet shutter 12*f*3 and sealing member 12*f*6 as shown in FIGS. 10 and 11, and then, the retaining member 12*f*2 is engaged with the toner supply container 12, with the doubled-back portion of the tape 12*f*4 put through the hole 12*f*2*d* of the retaining member 12*f*2, shown in FIG. 10. Then, the end of the doubled-back portion of the tape 12*f*4 is fixed to the outlet cover 12*f*1.

(Step for Filling Toner Supply Container with Toner)

After the cleaning of the toner supply container 12, toner is filled into the toner supply container 12 through the toner inlet 12*j*.

(Step for Reattaching Capping Member)

In the step for reattaching the capping member 12*i*, the capping member 12*i* is plugged into the toner inlet 12*j* of the toner supply container 12 to seal the inlet 12*j*.

(Step for Reattaching Capping Member Covering Member)

In the step for reattaching the capping member covering member 12*q*, which is carried out after the attachment of the capping member 12*i*, the capping member covering member 12*q* is solidly fixed to the toner supply container unit 12*z*, with the use of two or more securing means among adhesive agent, adhesive tape, and a set of connective members, while using each of the projections 12*k* of the toner supply container 12 as a guide, and the end wall 12*r*3 of the toner supply container 12 as a positioning reference. Incidentally, even if the end portion 12*k*2 of the projection 12*k* had been destroyed or lost during the disassembly of the toner supply container 12, in other words, even if the projection 12*k* is not fully functional as a positioning portion, the capping member covering member 12*q* can be accurately positioned relative to the toner supply container frame 12*r*, using, as positioning means, the lateral surfaces 12*q*11–12*q*16 of the capping member covering member 12*q*, and the lateral surfaces 12*r*11–12*r*14 of the toner supply container frame 12*r*, as positioning means, and can be solidly fixed to the toner supply container frame 12*r* with the use of two or more securing means among adhesive agent, adhesive tape, and a set of connective members.

(Step for Attaching Label)

Referring to FIG. 12, in the step for reattaching the capping member covering member 12*q*, the label 12*u* having the same color as that of the toner filled into the toner supply container 12 during the step for refilling the toner supply container 12 with toner is placed on the capping member covering member 12*q*. With the placement of this label 12*u*, it is possible to discern the color of the toner in the toner supply container 12 based on the color of the label 12*u*.

(Step for Rewriting Information in Information Storing Means, or Replacing Original Information Storing Means with New Information Storing Means and Writing Information Therein)

Referring to FIGS. 1 and 12, in this embodiment, an IC memory unit 12*t* is employed as a storage means capable of noncontact communication.

When remanufacturing the toner supply container 12, the IC memory unit 12*t* is removed from an IC memory bed 12*t*1 attached to the toner supply container 12, and necessary information is written into the IC memory unit 12*t*; the information in the IC memory unit 12*t* is replaced with the new information. Then, the IC memory unit 12*t* is solidly fixed to the IC memory bed 12*t*1 with the use of two-sided tape, adhesive agent, or the like.

Incidentally, it is possible to eliminate the above described process of removing the IC memory unit 12*t* from the IC memory bed 12*t*1. In other words, the information in the IC memory unit 12*t* can be rewritten without removing the IC memory unit 12*t* or IC memory bed 12*t*1 from the toner supply container 12. It also is possible to replace the original IC memory unit with a brand-new IC memory unit, and write the necessary information into the brand-new IC memory unit.

This process of writing necessary information into the IC memory unit 12*t* can be carried out any time, that is, with no regard to the sequential relationship between this process and any of the above described processes.

As will be evident from the above description, the toner supply container remanufacturing method in this embodiment, is for reusing collected used toner supply containers by refilling the toner supply containers with toner, and is one of the realizations of simple toner supply container remanufacturing methods, in which the structural components, for example, the toner supply container frame, the stirring member and toner conveying member disposed within the toner supply container frame, memory element having a communicating means for communicating with the main assembly of an image forming apparatus, coupling members for receiving driving force, etc., of a toner supply container can be more efficiently reused.

The following are the variations of the preferred embodiments of the present invention.

(Embodiment 1)

A remanufacturing method for the toner supply container 12 comprising the capping member 12*i* for sealing the toner inlet 12*j* and the capping member covering member 12*q* for covering the capping member 12*i*, and removably mountable in the main assembly of an image forming apparatus, characterized in that it comprises:

a first step in which the capping member covering member 12*q* is removed from the main assembly of the toner supply container, by destroying or removing the portions of the toner supply container, which were thermally deformed (thermally crimped) to attach the capping member covering member 12*q* to the main assembly of the toner supply container;

a second step in which the capping member 12*i* is removed to open the toner inlet 12*j;* a third step in which developer (toner, or mixture of toner and carrier) is filled into the toner supply container through the toner inlet 12*j;* a fourth step in which the toner inlet 12*j* is sealed with the capping member 12*i*; and a fifth step in which the capping member covering member 12*q* for covering the capping member 12*j* is attached.

(Embodiment 2)

A remanufacturing method, in accordance with the first embodiment of the present invention, for a toner supplying container having a member (label 12*u*) covering the portions of the capping member covering member 12*q*, which are in contact with the thermally deformed projections of the toner supply container frame, characterized in that in the first step, the label 12*u* is peeled to expose the thermally deformed portion, and then, the thermally deformed portion is removed.

(Embodiment 3)

A remanufacturing method, in accordance with the first or second embodiment of the present invention, for a toner supply container, the capping member covering member 12*q* of which are solidly attached to the main assembly of the toner supply container by thermally deforming one or more portions of the main assembly of the toner supply container, characterized in that in the first step, the thermally deformed portions are removed to remove the capping member covering member 12*q* from the main assembly of the toner supply container.

(Embodiment 4)

A remanufacturing method, in accordance with the first, second, or third embodiment of the present invention, for a toner supply container, characterized in that there is the step for cleaning the interior of the toner supply container, between the second and third steps.

(Embodiment 5)

A remanufacturing method, in accordance with the first, second, third, or fourth embodiment of the present invention, for a toner supply container, the main assembly of which is provided with a toner outlet (toner outlet 12*f*) for discharging the toner in the main assembly, characterized in that there is the step for sealing the toner outlet (for example, pasting tape 12*f*4 to main assembly of toner supply container) between the second and third steps.

(Embodiment 6)

A remanufacturing method, in accordance with one of the first–fifth embodiments of the present invention, for a toner supply container, characterized in that in the fifth step, the capping member covering member is attached with the use of one or more means among a bonding agent, an adhesive member, a set of connective members.

(Embodiment 7)

A remanufacturing method, in accordance with one among the first–sixth embodiments of the present invention, for a toner supply container, characterized in that the capping member covering member 12*q* attached in the fifth step is provided with a marker (for example, label 12*u* identical in color to toner in toner supply container) indicating the color of the toner filled into the toner supply container in the third step.

(Embodiment 8)

A remanufacturing method, in accordance with one among the first–seventh embodiments of the present invention, for a toner supply container having an information storage element (IC memory unit 12*t*) comprising a communicating means (communication antenna) capable of communicating (without requiring physical contact) with the communication means (communication control chip 31) of the main assembly of an image forming apparatus, characterized in that it comprises a step in which the original storage element is replaced with a storage element different in the information therein from the original storage element.

As will be evident from the above description of the preferred embodiments of the present invention, the present invention can provide a simple method for remanufacturing a toner supply container.

Further, the present invention can provide a method for remanufacturing a toner supply container, capable of preventing toner from leaking out from a toner supply container while the toner supply container is transported, or in the like situations.

Further, the present invention can provide a method for remanufacturing a toner supply container, capable of making commercially viable, a used toner supply container, that is, a toner supply container, the commercial value of which was lost because the amount of the toner therein reduced, due to consumption, to a level below which it is impossible to form an image high enough in quality to satisfy a user.

While the invention has been described with reference to the structures disclosed herein, it is not confined to the details set forth, and this application is intended to cover such modifications or changes as may come within the purposes of the improvements or the scope of the following claims.

What is claimed is:

1. A remanufacturing method for a developer supply container detachably mountable to a main assembly of an image forming apparatus, said developer supply container including a frame, a developer accommodating portion for accommodating a developer to be used by a developing device of the image forming apparatus, a developer filling opening for filling the developer into said developer accommodating portion, a capping member for closing said developer filling opening, and a cap covering member covering said capping member, said cap covering member being fixed by welding to said frame, said remanufacturing method comprising:

a cap covering member dismounting step of dismounting said cap covering member from said frame by separating cap covering member from said frame at a welded portion;

a capping member dismounting step of dismounting said capping member to open said developer filling opening;

a developer filling step of filling the developer using said developer filling opening; and a capping member mounting step of closing said developer filling opening by a capping member;

a cap covering member mounting step of mounting said cap covering member to said frame.

2. A method according to claim 1, wherein the welded portion is prevented from being exposed externally by a sticker member, and in said cap covering member dismounting step the welded portion is removed after the welded portion is exposed by removing the sticker member.

3. A method according to claim 1, further comprising a cleaning step of cleaning said developer accommodating portion between said capping member dismounting step and said developer filling step.

4. A method according to claim 1, wherein said frame is provided with developer supply opening for supplying the developer into the developing device from said developer accommodating portion, and said remanufacturing method further comprises a supply opening sealing step for sealing said developer supply opening between said capping member dismounting step and said developer filling step.

5. A method according to claim 1, wherein in said cap covering member mounting step, said cap covering member is mounted using at least one of an adhesive material, an adhesive member and a fastening member.

6. A method according to claim 1, wherein in said cap covering member mounting step, said cap covering member is provided with an indication permitting recognition of a color of the developer filled in said developer filling step.

7. A method according to claim 1, wherein said developer supply container is provided with a storing element including communicating means communicatable with communicating means provided in the main assembly of the apparatus, and said remanufacturing method further comprises a storing element exchanging process of exchanging said storing element with a storing element storing different information.

8. A method according to claim 1, wherein said cap covering member is fixed to said frame by a heat crimping portion provided by welding a free end of a projection extended from said frame, and in a cap covering member dismounting step, said heat crimping portion is removed, and said cap covering member is dismounted from said frame, and in said cap covering member mounting step, said cap covering member is engaged with the projection from which said heat crimping portion is removed, so that said cap covering member is mounted to said frame.

9. A method according to claim 8, wherein in said cap covering member dismounting step, said heat crimping portion is removed along a surface of said cap covering member.

10. A method according to claim 8, wherein in said cap covering member dismounting step said heat crimping portion is removed by an end mill cutter, a cutter or a nipper.

11. A method according to claim 8, wherein in said cap covering member dismounting step a tool is inserted between said frame and said cap covering member and is moved in a cap covering member dismounting direction to remove said heat crimping portion.

12. A method according to claim 8 or 11, wherein in said cap covering member dismounting step, said heat crimping portion is heated, and said cap covering member is moved in a cap covering member dismounting direction.

* * * * *